US009401255B2

(12) United States Patent
Kurita et al.

(10) Patent No.: US 9,401,255 B2
(45) Date of Patent: Jul. 26, 2016

(54) DRIVE DEVICE FOR OPENING/CLOSING BODY

(71) Applicants: SHIROKI CORPORATION, Kanagawa (JP); NISSAN MOTOR CO., LTD., Kanagawa (JP); TACHIBANA ELETECH CO., LTD., Osaka (JP)

(72) Inventors: Junya Kurita, Kanagawa (JP); Hiroharu Ozawa, Kanagawa (JP); Hideaki Nakamura, Kanagawa (JP); Takao Koba, Osaka (JP); Takaharu Kiyama, Osaka (JP)

(73) Assignees: SHIROKI CORPORATION, Kanagawa (JP); TACHIBANA ELETECH CO., LTD., Osaka (JP); NISSAN MOTOR CO., LTD., Kanagawa (JP)

( * ) Notice: Subject to any disclaimer, the term of this patent is extended or adjusted under 35 U.S.C. 154(b) by 269 days.

(21) Appl. No.: 14/368,302

(22) PCT Filed: Dec. 14, 2012

(86) PCT No.: PCT/JP2012/082438

§ 371 (c)(1),
(2) Date: Jun. 24, 2014

(87) PCT Pub. No.: WO2013/099646

PCT Pub. Date: Jul. 4, 2013

(65) Prior Publication Data

US 2014/0340808 A1 Nov. 20, 2014

(30) Foreign Application Priority Data

Dec. 28, 2011 (JP) ..... 2011-287268

(51) Int. Cl.

| | |
|---|---|
| ***H01H 47/00*** | (2006.01) |
| ***E05F 15/71*** | (2015.01) |
| *E05F 15/614* | (2015.01) |

(52) U.S. Cl.

CPC ..... *H01H 47/002* (2013.01); *E05F 15/71* (2015.01); *E05F 15/614* (2015.01); *E05Y 2900/546* (2013.01); *H01H 2047/003* (2013.01); *H01H 2231/026* (2013.01)

(58) Field of Classification Search

CPC ..... H01H 47/002; E05F 15/614; E05F 15/71; E05Y 2900/546

See application file for complete search history.

(56) References Cited

FOREIGN PATENT DOCUMENTS

| | | | |
|---|---|---|---|
| JP | 6-197591 A | | 7/1994 |
| JP | 2004106729 A | | 4/2004 |
| JP | 2007-165406 | * | 6/2007 |
| JP | 2009161966 A | | 7/2009 |

OTHER PUBLICATIONS

International Search Report and Written Opinion from PCT/JP2012/082438 dated Mar. 12, 2013.

* cited by examiner

*Primary Examiner* — Thienvu Tran
*Assistant Examiner* — Tien Mai
(74) *Attorney, Agent, or Firm* — Millen, White, Zelano & Branigan, P.C.

(57) ABSTRACT

An opening/closing-body drive device is achieved, in which a malfunction, caused by the electrical contacts of the relay switch freezing, can be reliably prevented from occurring. The control unit 60 includes a freeze determiner 61 which determines that the relay switch(es) is frozen when an opening/closing-body drive motor 27*a* does not drive a specified amount in accordance with opening/closing operational conditions of a back door 3 and when the temperature of the control unit 60 that is detected by a temperature detector 80 is lower or equal to a predetermined value; and a freeze releaser 62 which releases a frozen state of the relay switch(es) by intermittently supplying electric current for a predetermined number of times to the relay switch(es) without supplying a drive current to said opening/closing-body drive motor 27*a*, when said freeze determiner 61 determines that the relay switch(es) is frozen.

3 Claims, 16 Drawing Sheets

FIG. 13

| State | Relay Switch State | Motor Rotational Operation | Back Door Opening/Closing Operation | State of Circuit Configured by Release Switches S2 and S3 |
|---|---|---|---|---|
| 1 | S1:OFF S2:A-I S3:C-II | Not Rotating | Not Opening/Closing | Open Circuit |
| 2 | S1:OFF S2:B-I S3:C-II | Not Rotating | Not Opening/Closing | Close Circuit (Regeneration Brake) |
| 3 | S1:OFF S2:A-I S3:D-II | Not Rotating | Not Opening/Closing | Close Circuit (Regeneration Brake) |
| 4 | S1:OFF S2:B-I S3:D-II | Not Rotating | Not Opening/Closing | Open Circuit |
| 5 | S1:ON S2:A-I S3:C-II | Forward Rotation | Closing | Open Circuit |
| 6 | S1:ON S2:B-I S3:C-II | Not Rotating | Not Opening/Closing | Close Circuit (Regeneration Brake) |
| 7 | S1:ON S2:A-I S3:D-II | Not Rotating | Not Opening/Closing | Close Circuit (Regeneration Brake) |
| 8 | S1:ON S2:B-I S3:D-II | Reverse Rotation | Opening | Open Circuit |

DRIVE DEVICE FOR OPENING/CLOSING BODY

TECHNICAL FIELD

The present invention relates to a drive device for an opening/closing body for, e.g., a vehicle door (back door), a power-trunk lid or a swing door, etc.

BACKGROUND ART

In the related art, a drive device for an opening/closing body, is known, which is provided with an opening/closing body which opens and closes an opening in a vehicle body, an opening/closing-body drive motor which drives the opening/closing body in an opening and closing manner by rotating forwardly and reversibly, a battery which generates a driving current for the opening/closing-body drive motor, a supplier which supplies driving current that is generated by the battery to the opening/closing-body drive motor, and a switching device which switches forward/reverse rotation direction of the opening/closing-body drive motor. At least one of the supplier and the switching device is provided with a relay switch (Patent Literature 1).

CITATION LIST

Patent Literature

Patent Literature 1: Japanese Unexamined Patent Publication No. 2004-106729

SUMMARY OF THE INVENTION

Technical Problem

However, in the related art, there is a problem with the electrical contacts of the relay switch freezing when left for a long period of time in a low-temperature high humidity state so that the relay switch is no longer switchable, the drive current cannot be supplied to the opening/closing-body drive motor, and so that a malfunction occurs, such as the opening/closing body not being able to open and close. In order to resolve such a malfunction, for example, it is necessary for the driver (or passenger) to spend time repetitively operating (repeating the operational conditions) the open-operation switch, posing an obstacle to the smooth opening/closing operation thereof.

The present invention has been devised in consideration of the above-mentioned problems, and it is an objective to provide a drive device for an opening/closing body which can reliably prevent a malfunction, caused by the electrical contacts of the relay switch freezing, from occurring.

Solution to Problem

The present invention is characterized by an opening/closing body drive device, including an opening/closing body which opens and closes an opening; an opening/closing-body drive motor, which drives the opening/closing body to open and close by a forward/reverse rotation of the opening/closing-body drive motor; a battery which generates drive current for the opening/closing-body drive motor; a supplier which supplies the drive current that is generated by the battery to the opening/closing-body drive motor; a switching device which switches the forward/reverse rotational direction of the opening/closing-body drive motor; a control unit which controls the supplier and the switching device based on opening/closing operational conditions of the opening/closing body; and a temperature detector which detects the temperature of the control unit. At least one of the supplier and the switching device includes a relay switch. The control unit includes a freeze determiner which determines that the relay switch is frozen when the opening/closing-body drive motor does not drive a specified amount in accordance with the opening/closing operational conditions of the opening/closing body and when the temperature of the control unit that is detected by the temperature detector is lower or equal to a predetermined value; and a freeze releaser which releases a frozen state of the relay switch by intermittently supplying electric current for a predetermined number of times to the relay switch without supplying a drive current to the opening/closing-body drive motor, when the freeze determiner determines that the relay switch is frozen.

In the present specification, the "opening/closing operational conditions of the opening/closing body" refers to, e.g., the input of an open instruction signal from the open operational switch to instruct the opening of the opening/closing body via the opening/closing-body drive motor, or the detection of a half-latched state of the lock mechanism.

The supplier and the switching device are configured of the relay switches, wherein the relay switches can include three relay switches: a first relay switch which switches ON and OFF the supply of the drive current generated by the battery to the opening/closing-body drive motor, and second and third relay switches which change the direction of supply of the drive current generated by the battery to the opening/closing-body drive motor.

The opening/closing body drive device according to the present invention can further include a sector gear which rotates between an initial position and a position other than the initial position, in accordance with the forward/reverse rotation of the opening/closing-body drive motor. The freeze determiner determines that the relay switch is frozen when the sector gear cannot return to the initial position thereof from a position other than the initial position due to the opening/closing-body drive motor not being able to be driven forwardly, after the sector gear has been moved from the initial position to a position other than the initial position so that the opening/closing body is in an opened state by reversibly driving the opening/closing-body drive motor from the fully-closed state of the opening/closing body, and when the temperature of the control unit detected by the temperature detector is less than or equal to said predetermined temperature.

Advantageous Effects of the Invention

According to the invention pertaining to claim 1, a malfunction, caused by the electrical contacts of the relay switch freezing, can be reliably prevented from occurring due to the freezing of the relay switch being released by the freeze determiner determining that the relay switch has frozen when the opening/closing-body drive motor does not drive a specified amount in accordance with the opening/closing operational conditions of the opening/closing body and when the temperature of the controller, detected by the temperature detector, is less than or equal to a predetermined temperature, and by the freeze releaser intermittently supplying current at a predetermined number of times to the relay switch, upon the opening/closing-body drive motor being in a state where the drive current is not supplied thereto, when the freeze determiner determines that the relay switch has frozen. Moreover, since the opening/closing-body drive motor can be prevented from immediately commencing to drive upon the frozen state of the relay switch being released, the operational stability can be improved.

According to the invention pertaining to claim 2, a drive circuit, including a supplier and a switching device, can be configured with a minimum required number of relay switches, and simplification and cost-reduction of the drive circuit can be achieved.

According to the invention pertaining to claim 3, even in the case where the sector gear cannot return to a neutral position (at which the sector gear is returned to the initial position) from a position other than the initial position due to the forward/reverse rotational direction of the opening/closing-body drive motor not being able to switch because the relay switch, constituting a switching device, is frozen, the sector gear can be returned to the initial position from a position other than the initial position by instantaneously determining that the relay switch is frozen and by releasing the relay switch from such a state.

BRIEF DESCRIPTION OF DRAWINGS

FIG. 13 shows the relationship between the states of the first relay switch through the third relay switch, the rotational operation of the motor, the opening/closing operation of the back door, and the state of the circuit that is configured by the second relay switch and the third relay switch;

DESCRIPTION OF EMBODIMENTS

Figure 1:
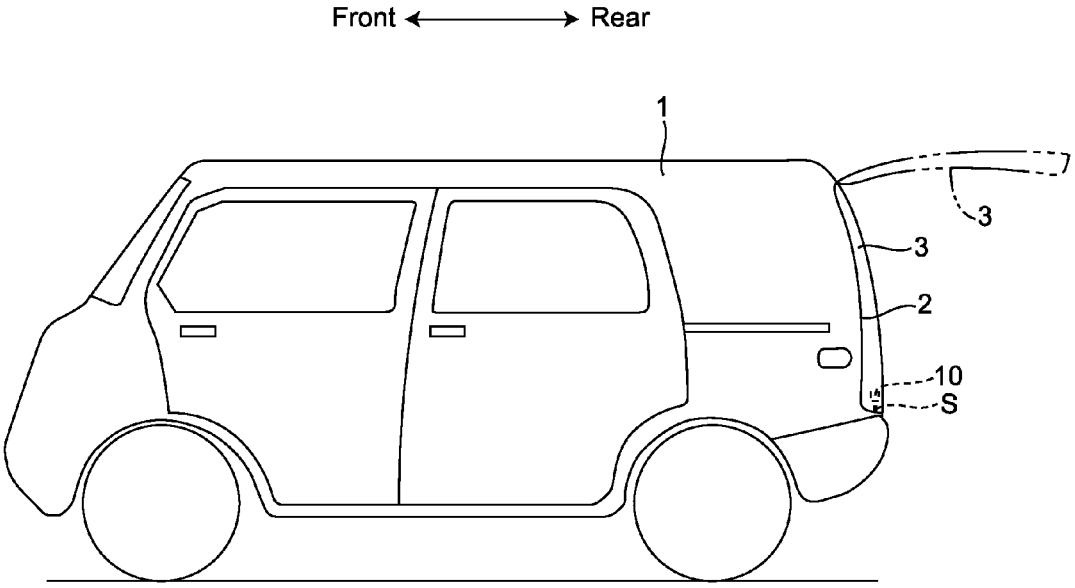
FIG. 1 is a side view of a vehicle door closure device, to which a drive device for an opening/closing body of the present invention is applied.

An embodiment of a drive device, for a vehicle opening/closing body, in which the opening/closing body drive device of the present invention is applied to a vehicle door closure device, will be hereinafter discussed with reference to FIGS. 1 through 18. As shown in FIG. 1, a door closure device (drive device for a vehicle opening/closing body) is provided with a back door (opening/closing body) 3 which opens and closes a rear opening (opening) 2 of a vehicle body 1. The back door 3 is mounted to the upper edge of the rear opening 2 to be rotatable about a rotational axis extending in the leftward/rightward direction (horizontal direction).

As shown in FIG. 1 and FIGS. 8 through 10, the door closure device is provided with a lock mechanism 10 that is mounted onto the back door 3. Furthermore, a lower edge portion of the rear opening 2 of the vehicle body 1 is provided with a striker S, which disengageably engages with the lock mechanism 10. The lock mechanism 10 holds the back door 3 in a state which closes the rear opening 2, and the lock mechanism 10 switches between an open state, a half-latched state and a fully-latched state, in accordance with the opening amount of the back door 3 with respect to the rear opening 2.

Figure 2:
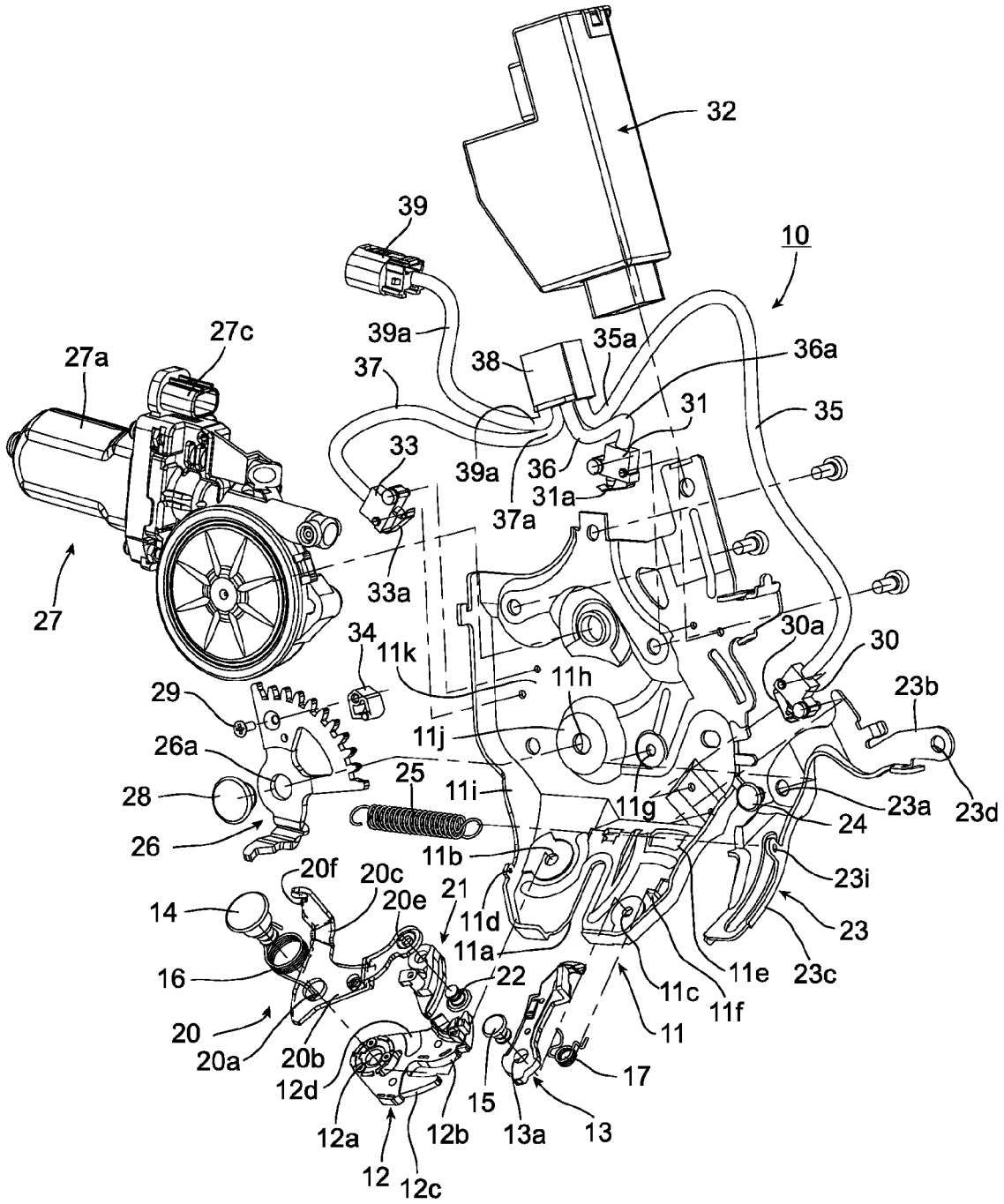
FIG. 2 is an exploded perspective view of a lock device.

As shown in FIG. 2, the lock mechanism 10 is provided with a metal base plate 11 that is fixedly attached to the back door 3. A striker entry groove 11*a*, into which the striker S can enter, is formed in the base plate 11, and a pivot pin 14 and a pivot pin 15 are fixed in shaft-supporting holes 11*b* and 11*c*, which are positioned on either side of the striker entry groove 11*a*. The pivot pin 14 is inserted through a shaft hole 12*a* formed in a hook 12, and the hook 12 is rotatably supported about the pivot pin 14. The pivot pin 15 is inserted through a shaft hole 13*a* formed in a ratchet 13, and the ratchet 13 is rotatably supported about the pivot pin 15.

Figure 3:
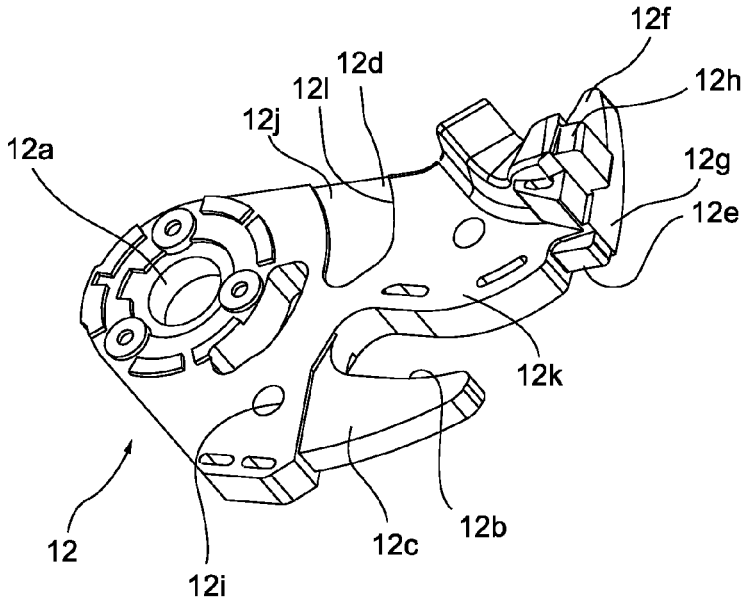
FIG. 3 is a perspective view showing a hook, of the lock device, as a basic element.

As shown in FIG. 3, a hook body 12*j*, which forms the base of the hook 12, is made of metal. The hook body 12*j* is provided with a striker holding groove 12*b*, which is formed in a substantially radial direction, centered about the shaft hole 12*a*, and a first leg portion 12*c* and a second leg portion 12*d* which are positioned on either side of the striker holding groove 12*b*. A ratchet-engaging stepped portion 12*e*, which faces the striker holding groove 12*b*, is provided near an end portion of the second leg 12*d*, and a ratchet pressure projection 12*f* is formed on the opposite side of the end portion of the second leg portion 12*d* with respect to the ratchet-engaging stepped portion 12*e*. In addition, an end of the second leg portion 12*d* which connects the ratchet-engaging stepped portion 12*e* and the ratchet pressure projection 12*f* to each other is formed into a convex-shaped circular arc surface 12*g*. Additionally, a coupling projection 12*h* is formed on the second leg portion 12*d* to project in a direction away from the base plate 11. The hook 12 is rotatable between a striker releasing position shown in FIG. 8 and a striker holding position shown in FIG. 10, and is biased to rotate toward the striker releasing position (clockwise direction with respect to FIGS. 8 through 10) by a torsion spring 16. The torsion spring 16 is provided with a coiled portion which surrounds the pivot pin 14 and a pair of spring ends which are engaged with a spring hooking hole 12*i* of the hook 12 and a spring hooking hole 11*d* of the base plate 11, respectively. A surface of the hook body 12*j* is covered with a hook cover 12*k* made of resin. However, the hook cover 12*k* exposes the first leg portion 12*c*, the ratchet-engaging stepped portion 12*e*, the ratchet pressure projection 12*f*, the circular arc surface 12*g* and the coupling projection 12*h*, and the hook cover 12*k* is provided with a cutout 12*l* for exposing the base of the second leg portion 12*d*.

Figure 4:
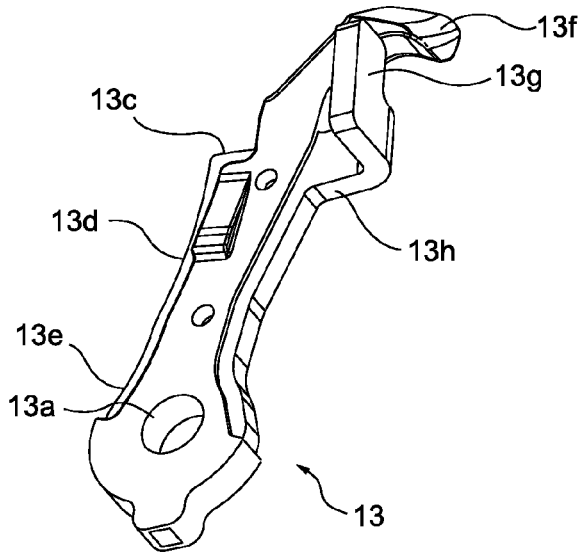
FIG. 4 is a perspective view showing a ratchet, of the lock device, as a basic element.

As shown in FIG. 4, the ratchet 13 is provided with a guide projection (not shown) which is engaged with a ratchet guide groove 11*e* formed in the base plate 11 to be slidable thereon. The ratchet 13 is provided, on a side thereof facing the hook 12, with a rotation-restriction stepped portion 13*c* which is engageable with the ratchet-engaging stepped portion 12*e*. A concave-shaped circular-arc surface portion 13*d*, which corresponds in shape to the circular arc surface 12*g* of the hook 12, is formed on a side surface of the ratchet 13 that is continuous with the rotation-restriction stepped portion 13*c*, and a smoothly-stepped portion 13*e* is formed on a portion of the circular-arc surface portion 13*d* in the vicinity of the base end of the ratchet 13 toward the pivotal hole 13*a*. Additionally, the ratchet 13 is provided, in the vicinity of the end thereof that is distant from the pivotal hole 13*a*, with a switch operating member 13*f*, and is provided with a pressed member 13*g* on the opposite side of the ratchet 13 from the circular-arc surface portion 13*d*. The ratchet 13 is rotatable between a latching position (FIGS. 8 and 10) in which the ratchet 13 is positioned close to the hook 12 so that the rotation-restriction stepped portion 13*c* is positioned in a moving path of the ratchet-engaging stepped portion 12*e* of the hook 12 (in which the rotation-restriction stepped portion 13*c* is engageable with the ratchet-engaging stepped portion 12*e*) and an unlatching position (FIG. 9) in which the rotation-restriction stepped portion 13*c* is retracted from a position in the moving path of the ratchet-engaging stepped portion 12*e* (in which the rotation-restriction stepped portion 13*c* is not engaged with the ratchet-engaging stepped portion 12*e*), and is biased to rotate toward the latching position (in the counterclockwise direction with respect to FIGS. 8 through 10) by a torsion spring 17. The torsion spring 17 is provided with a coiled portion which surrounds the pivot pin 15 and a pair of spring ends which are engaged with a spring hooking portion 13*h* of the ratchet 13 and a spring hooking hole 11*f* (see FIG. 2) of the base plate 11, respectively.

Figure 5:
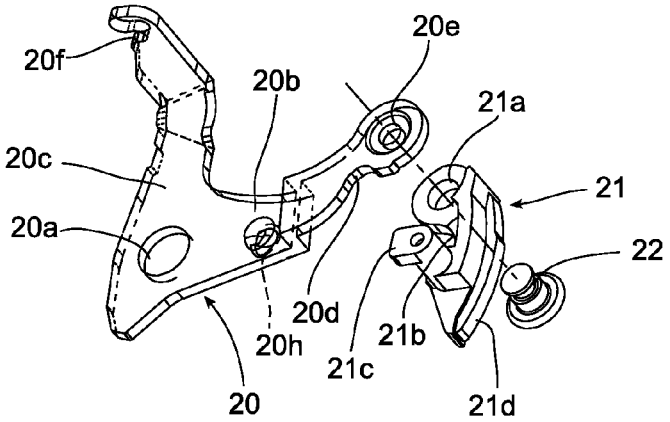
FIG. 5 is a perspective view of a closing lever and an inter-linked lever of the lock device.

The pivot pin 14 is also inserted into a pivotal hole 20*a* of a closing lever 20, and the closing lever 20 is supported by the pivot pin 14 to be rotatable independently about the pivot pin 14 relative to the hook 12. As shown in FIG. 5, the closing lever 20 is substantially L-shaped, has a first arm 20*b* and a second arm 20*c* which extend radially about the pivotal hole 20*a*, and is rotatable between a draw-in releasing position (FIGS. 8 and 9) in which the closing lever 20 is positioned toward the striker releasing position of the hook 12 that rotates coaxially with the closing lever 20, and a draw-in position (FIG. 10) in which the closing lever 20 is positioned toward the striker holding position of the hook 12.

A recess 20*d* with which the coupling projection 12*h* of the hook 12 can come into contact, and a pivot support hole 20*e*, in which a pivot pin 22 is inserted to be supported thereby, are formed on a portion of the closing lever 20 in the vicinity of the end of the first arm 20*b*. In addition, a sliding projection 20*h* which slides on the second leg portion 12*d* through the cutout 12*l* is projected from a surface of the closing lever 20 which faces the hook 12. The pivot pin 22 is inserted into a pivotal hole 21*a* of an interlinking lever 21, and the interlinking lever 21 is pivoted on the closing lever 20 to be rotatable about the pivot pin 22. As shown in FIG. 5, the interlinking lever 21 is provided on a side thereof with a coupling recess 21*b* having a shape corresponding to the shape of the coupling projection 12*h* of the hook 12, and the interlinking lever 21 is rotatable between a coupling position (in which the interlinking lever 21 is engageable with the coupling projection 12*h*) (FIGS. 9 and 10), in which the coupling recess 21*b* is positioned in a moving path of the coupling projection 12*h* of the hook 12, and a coupling disengaging position (in which the interlinking lever 21 is not engaged with the coupling projection 12*h*) (FIG. 8), in which the coupling recess 21*b* is retracted from a position in the moving path of the coupling projection 12*h* of the hook 12. The interlinking lever 21 is further provided in the vicinity of the coupling recess 21*b* with a control projection 21*c* which projects in a direction away from the base plate 11, and is provided with a ratchet pressure projection 21*d* at the end of the interlinking lever 21 on the opposite side from the base end thereof that includes the pivotal hole 21*a*.

Figure 6:
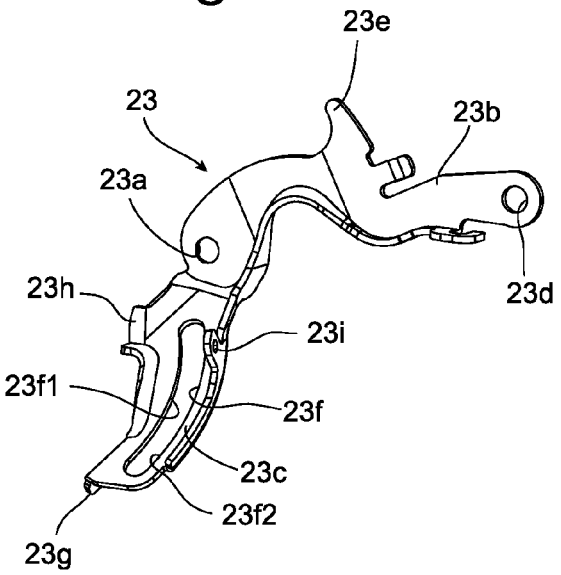
FIG. 6 is a perspective view showing an open lever, of the lock device, as a basic element.
Figure 8:
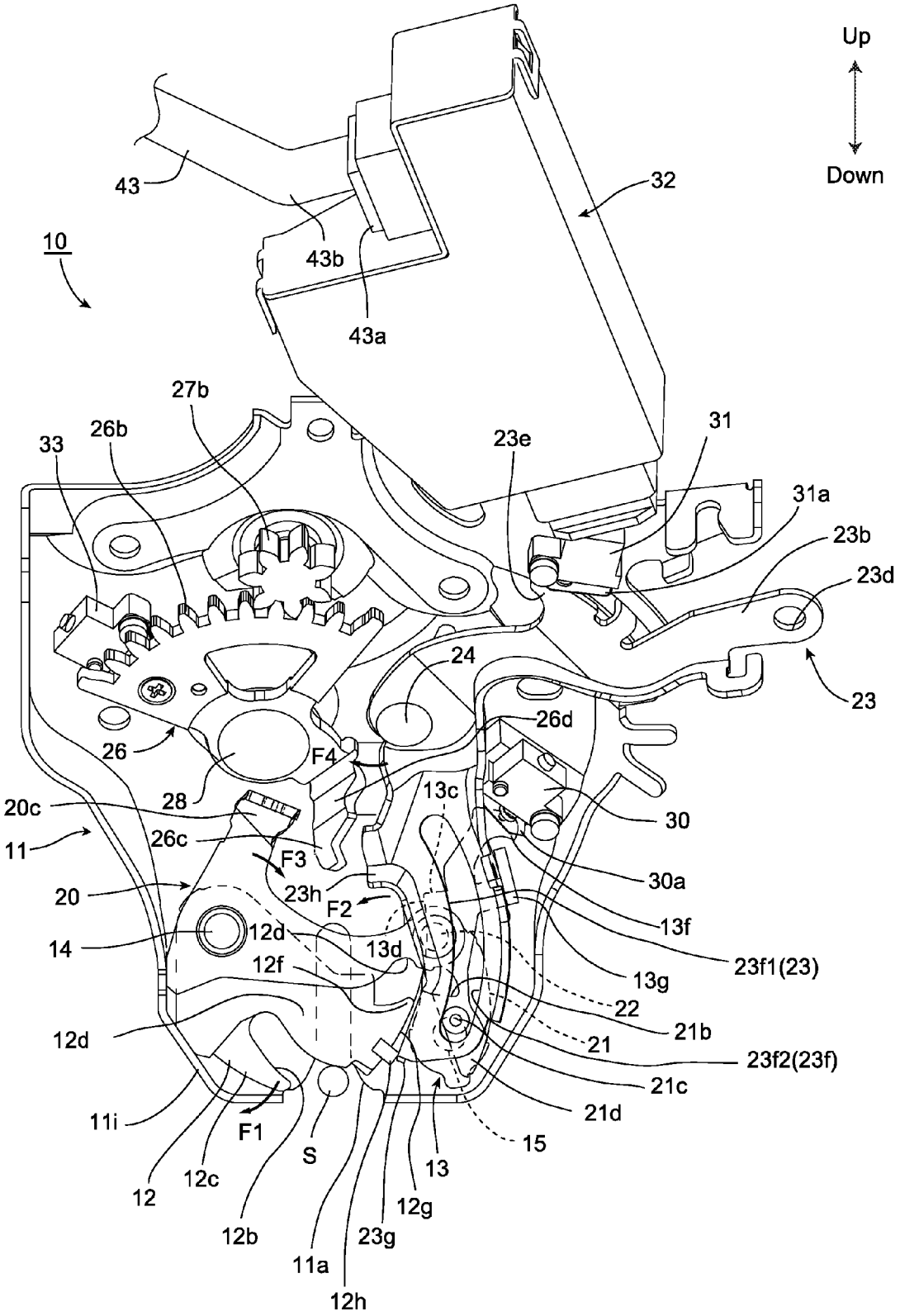
FIG. 8 is a plan view showing the lock device when a back door is positioned near a fully-closed position.
Figure 9:
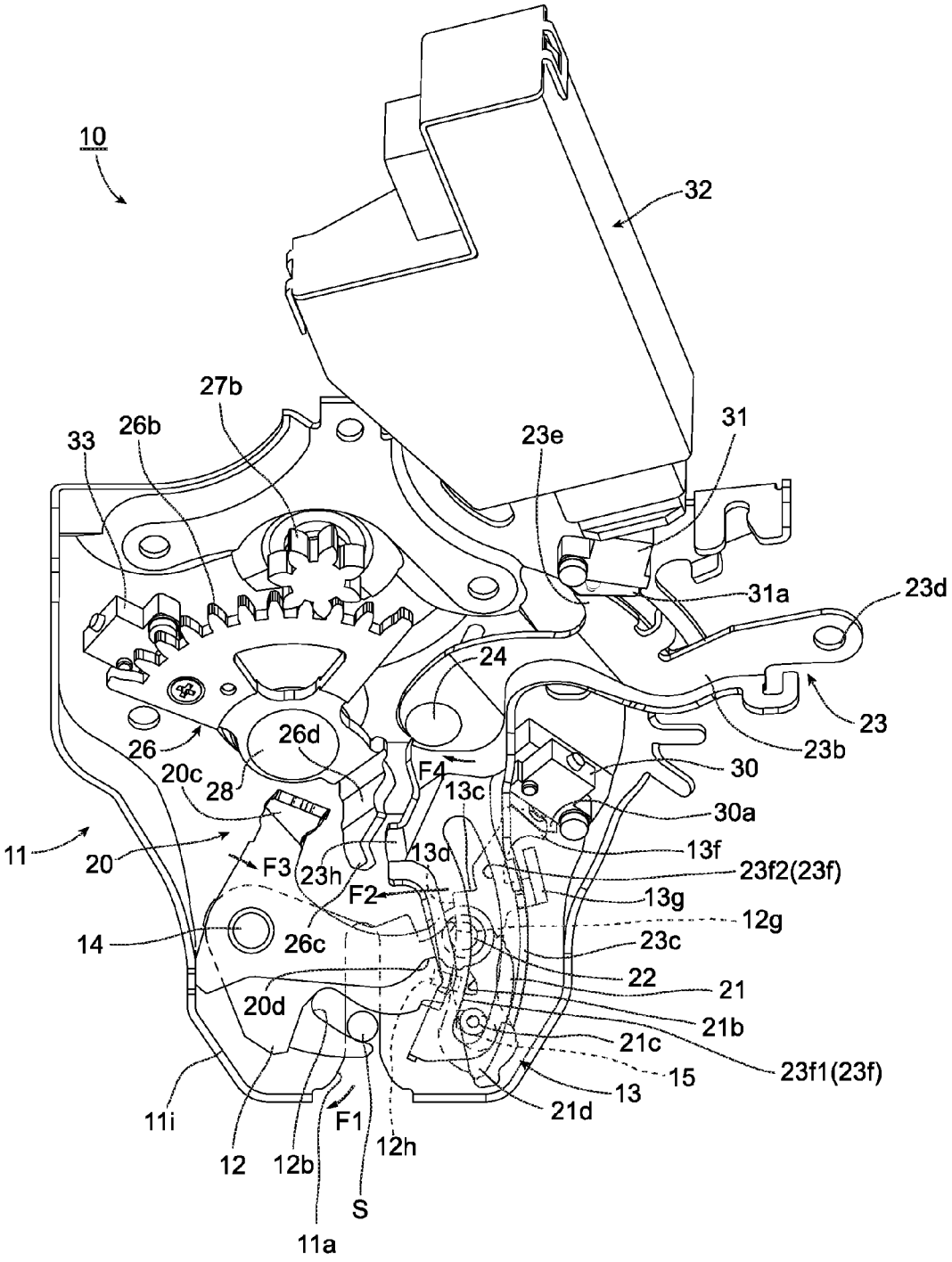
FIG. 9 is a plan view showing the lock device in a half-latched state.
Figure 10:
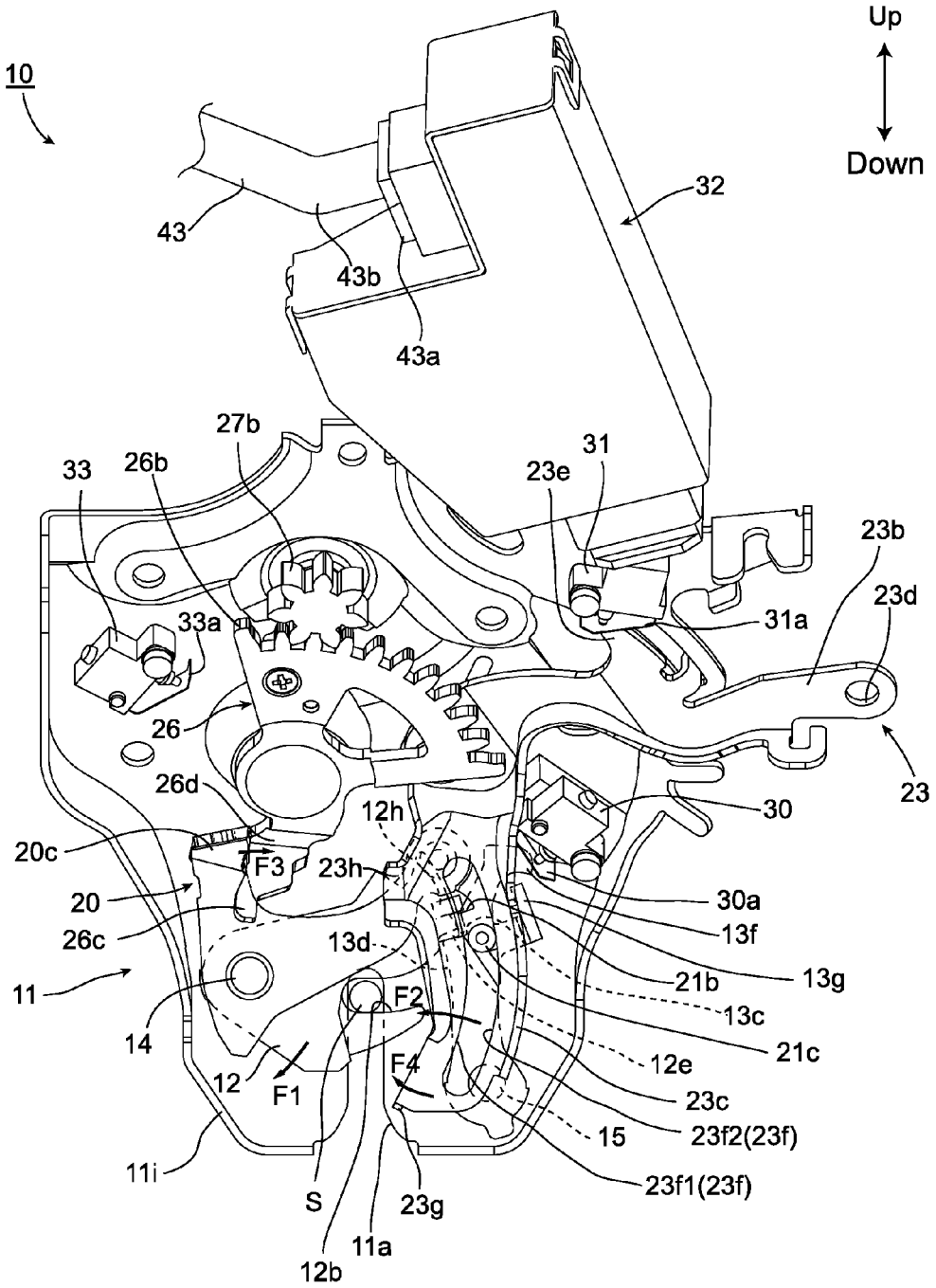
FIG. 10 is a plan view showing the lock device in a state where the operation of moving to a fully-latched state is completed.

A pivot pin 24 is fixed to a pivot support hole 11*g* of the base plate 11, and a pivotal hole 23*a* formed in an open lever 23 is rotatably fitted on the pivot pin 24. As shown in FIG. 6, the open lever 23 is provided with a first arm 23*b* and a second arm 23*c* which extend in different directions with the pivotal hole 23*a* as the center. The open lever 23 is provided in the vicinity of an end of the first arm 23*b* with a handle interlinking hole 23*d* that is linked with an end of an emergency release handle, not shown in the drawings, and is provided at a midpoint between the pivotal hole 23*a* and the handle interlinking hole with a switch operating member 23*e*. In addition, the first arm 23*b* is linked with an end of a wire, the other end of which is linked with a key apparatus not shown in the drawings. The second arm 23*c* is positioned to generally superpose the ratchet 13 as viewed in a plan view as shown in FIGS. 8 through 10, and is provided with an interlinking-lever control hole 23*f* in which the control projection 21*c* of the interlinking lever 21 is inserted, a rotation restriction wall 23*g* that is capable of coming in contact with the coupling projection 12*h* of the hook 12, and a gear contact portion 23*h* which faces a sector gear 26, which will be discussed later. The interlinking-lever control hole 23*f* is a circular-arc-shaped elongated hole which progressively increases in width toward the end of the second arm 23*c* (toward the draw-in releasing position of the closing lever 20) from the side closer to the pivotal hole 23*a* (toward the draw-in position of the closing lever 20) and includes an inner arc surface 23*f*1 and an outer arc surface 23*f*2, the central axes of which are mutually different. The open lever 23 is rotatable between a closing position (FIGS. 9 and 10) at which the second arm 23*c* thereof, which has the interlinking-lever control hole 23*f*, is displaced toward the latching position of the ratchet 13, and an opening position (FIG. 8) at which the second arm 23*c* is displaced toward the unlatching position of the ratchet 13.

An extension spring 25 is extended and installed between a spring hook 20*f* formed on the second arm 20*c* of the closing lever 20 and a spring hook 23*i* formed on the second arm 23*c* of the open lever 23. The closing lever 20 is biased to rotate toward the aforementioned draw-in releasing position (clockwise direction with respect to FIGS. 8 through 10) by the extension spring 25, while the open lever 23 is biased to rotate toward the aforementioned closing position (clockwise direction with respect to FIGS. 8 through 10) by the extension spring 25.

Figure 7:
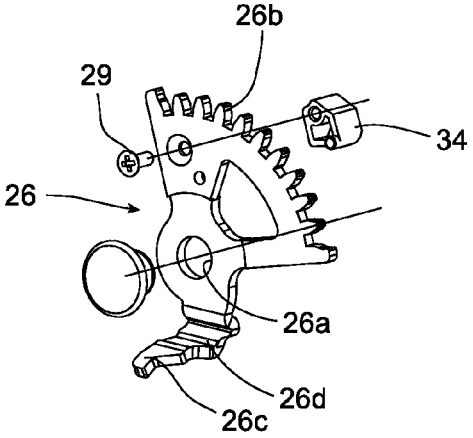
FIG. 7 is a perspective view of a sector gear and a press member, of the lock device, as basic elements.

A pivotal support hole 11*h* is formed in a support projection 11*j* which is projected from a portion of the base plate 11 in the vicinity of the center thereof, and a portion of the base plate 11 around the support projection 11*j* is formed as an annular stepped portion 11*k* which extends in a circumferential direction about the support projection 11*j*. A pivot pin 28 is fixed into the pivotal support hole 11*h*, and a pivotal hole 26*a* of the sector gear 26 that is made of metal is rotatably fitted on the pivot pin 28. As shown in FIG. 7, the sector gear 26 is provided with a gear portion 26*b* which is formed on the peripheral edge of a sector portion of the sector gear 26 about the pivotal hole 26*a*, an open-lever operating piece 26*c* which is capable of coming in contact with the gear contact portion 23*h* of the open lever 23, and a closing lever operating portion 26*d* which is continuous with the open-lever operating piece 26*c* and capable of engaging with the second arm 20*c* of the closing lever 20. As shown in FIG. 7, the open-lever operating piece 26*c* and the closing lever operating portion 26*d* are substantially orthogonal to the other part of the sector gear 26, and the closing lever operating portion 26*d* is formed to have a greater width than that of the open-lever operating piece 26*c*. Additionally, a pressing member 34 made of synthetic resin is fixed to the sector gear 26 by a screw 29, and the pressing member 34 forms a minute clearance between the pressing member 34 and the annular stepped portion 11*k*. A motor unit 27 fixed on the base plate 11 is provided with a pinion 27*b* which is driven to rotate forward and reverse by a motor (opening/closing-body drive motor) 27*a*, and the pinion 27*b* is engaged with the gear portion 26*b*. The motor unit 27 and the sector gear 26 constitute a closure mechanism which switches between the half-latched state and the fully-latched state of the opening state of the back door 3 via the driving of the motor.

A ratchet detection switch 30 and an open-lever detection switch 31 are mounted on the base plate 11. The ratchet detection switch 30 is a switch which can be pressed by the switch operating member 13*f* that is provided on the ratchet 13, and the open-lever detection switch 31 is a switch which can be pressed by the switch operating member 23*e* that is provided on the open lever 23. More specifically, the ratchet detection switch 30 is in a switch-OFF state, in which the switch operating member 13*f* is spaced from a switch leaf 30*a*, when the ratchet 13 is in the latching position shown in FIGS. 8 and 10, and the switch operating member 13*f* presses the switch leaf 30*a* to thereby turn ON the ratchet detection switch 30 upon the ratchet 13 being rotated to the unlatching position shown in FIG. 9. In addition, the open-lever detection switch 31 is in a switch-OFF state in which the switch operating member 23*e* is spaced from a switch leaf 31*a* when the open lever 23 is in the closing position shown in FIGS. 9 and 10, and the switch operating member 23*e* presses the switch leaf 31*a* to thereby turn ON the open-lever detection switch 31 upon the open lever 23 being rotated to the opening position shown in FIG. 8.

The lock mechanism 10 is also provided with a sector gear detection switch 33 (FIGS. 2, 8, etc.), provided with a switch leaf 33*a*, for detecting an initial position of the sector gear 26. As shown in the drawings, the sector gear detection switch 33 is fixed to the annular stepped portion 11*k* of the base plate 11 by a screw, and both the switch leaf 33*a* and the pressing member 34 lie on a single plane that is parallel to the rotational direction of the sector gear 26. The ON/OFF states of the ratchet detection switch 30, the open-lever detection switch 31 and the sector gear detection switch 33 are input to an electronic control unit (ECU) 32, and the electronic control unit 32 controls the operation of the motor unit 27 in a manner which will be discussed later.

Figure 11:
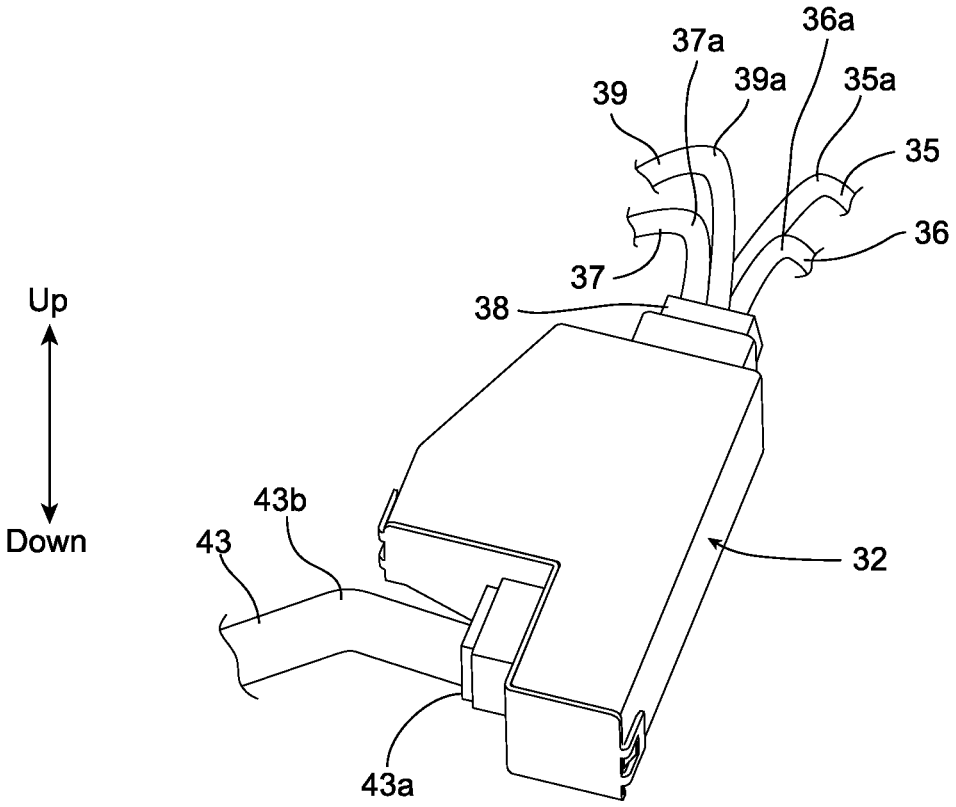
FIG. 11 is a perspective view of an electronic control unit (ECU) and peripheral members thereof.

As shown in FIG. 2, wire harnesses 35, 36 and 37, which are flexible as a whole and are provided with harnesses made of a conductive material and tubular sheaths made of an insulating material that cover the peripheries of the harnesses, are connected at one end of the wire harnesses 35, 36 and 37 to the ratchet detection switch 30, the open-lever detection switch 31 and the sector gear detection switch 33, respectively, and the other end of the wire harnesses 35, 36 and 37 are connected to a connector 38. An end of a wire harness 39 which is identical in structure to the wire harnesses 35, 36 and 37 is connected to the connector 38, and the wire harness 39 is provided at the other end thereof with a connector 39*a* which is connected to a socket 27*c* of the motor unit 27. As shown in FIGS. 2 and 11, bent portions 35*a*, 36*a*, 37*a* and 39*a* are formed on portions of the wire harnesses 35, 36, 37 and 39 in the vicinity of the ends thereof on the connector 38 side, respectively. Accordingly, when the back door 3 is positioned in the fully-closed position or in the vicinity of the fully-closed position, the wire harnesses 35, 36, 37 and 39 extend obliquely downwards from the connector 38 toward the bent portions 35*a*, 36*a*, 37*a* and 39*a*, respectively, and portions of the wire harnesses 35, 36, 37 and 39 beyond the bent portions 35*a*, 36*a*, 37*a* and 39*a* extend obliquely upward from the bent portions 35*a*, 36*a*, 37*a* and 39*a*, respectively.

The electronic control unit 32 is fixed to the end of the base plate 11 on the opposite side from the striker entry groove 11*a* by a plurality of screws. As shown in the drawings, the axis of the electronic control unit 32, which fixed to the base plate 11, is inclined with respect to the vertical direction.

A connector (male connector) 43*a* (see FIGS. 8, 10 and 11) provided at an end of a wire harness 43 (having the same structure as the wire harnesses 35, 36 and 37) electrically connected to a battery 50 (FIG. 12) (for supplying power to the motor 27*a*, the ratchet detection switch 30, the open-lever detection switch 31, the electronic control unit 32, the sector gear position detection switch 33, and the opening operation switch 33A etc.) provided in the vehicle body 1 is connected to the electronic control unit 32. As shown in FIGS. 8, 10 and 11, the wire harness 43 is provided with a bent portion 43*b* in the vicinity of the end of the wire harness 43 on the connector 43*a* side. Accordingly, when the back door 3 is positioned in the vicinity of the fully-closed position or the fully-closed position, the wire harness 43 extends obliquely downwards from the connector 43*a* toward the bent portion 43*b*, and the portion of the wire harness 43 from the bent portion 43*b* onwards extends obliquely upward.

Furthermore, the connector 38, which is provided at end of the wire harnesses 35, 36, 37 and 39 which are electrically connected to the ratchet detection switch 30, the open-lever detection switch 31, the sector gear position detection switch 33 and the motor unit 27, is connected to the electronic control unit 32.

Figure 12:
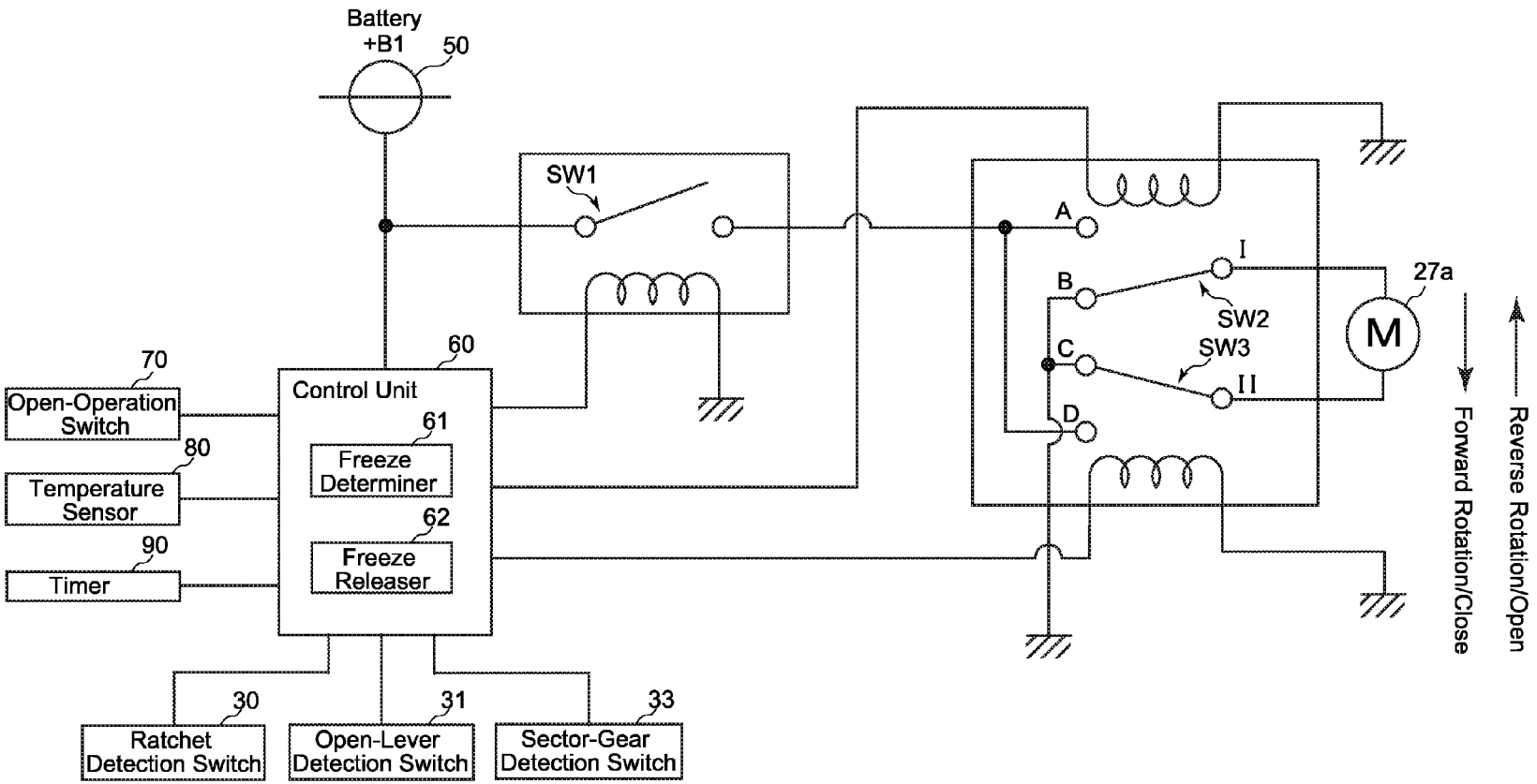
FIG. 12 is a circuit block diagram showing the circuit configuration of the drive device of the opening/closing body according to the present invention.

FIG. 12 is a circuit block diagram showing the circuit configuration of a vehicle opening/closing body drive device according to the present invention. The vehicle opening/closing body drive device is provided with a battery (power source) 50 that generates a drive current, and a first relay switch SW1, a second relay switch SW2 and a third relay switch SW3 which determine whether or not the drive current that is generated by the battery 50 is supplied to the motor (opening/closing-body drive motor) 27*a* and which switch the direction of the supply of the drive current. The first through third relay switches SW1 through SW3 function as a "supplier" which supplies drive current generated by the battery 50 to the motor 27*a*. Furthermore, the relay switch SW2 and the relay switch SW3 function as a "switching device" for switching the forward/reverse rotational direction of the motor 27*a* by the switching the direction of the supply of the drive current generated by the battery 50 to the motor 27*a*.

The first relay switch SW1 is switchable between an ON state and an OFF state.

The second relay switch SW2 is switchable between a state in which points A and I are conductive, and a state in which points B and I are conductive.

The third relay switch SW3 is switchable between a state in which points C and II are conductive, and a state in which points D and II are conductive.

FIG. 13 shows the relationship between the states of the first relay switch SW1 through the third relay switch SW3, the rotational operation of the motor 27*a*, the opening/closing operation of the back door 3, and the state of the circuit that is configured by the second relay switch SW2 and the third relay switch SW3. FIGS. 14(A) through 14(H) are circuit block diagrams respectively corresponding to states 1 through 8 of FIG. 13.

As shown in FIGS. 14(A) through 14(D), when the first relay switch SW1 is in an OFF state, the motor 27*a* does not rotate and the back door 3 does not open/close, regardless of the states of the second relay switch SW2 and the third relay switch SW3 (states 1 through 4).

Figure 14A:
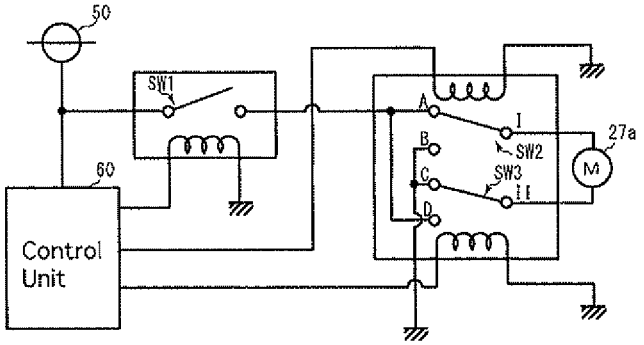
FIG. 14A—Circuit block diagram corresponding to state 1 of FIG. 13.
Figure 14B:
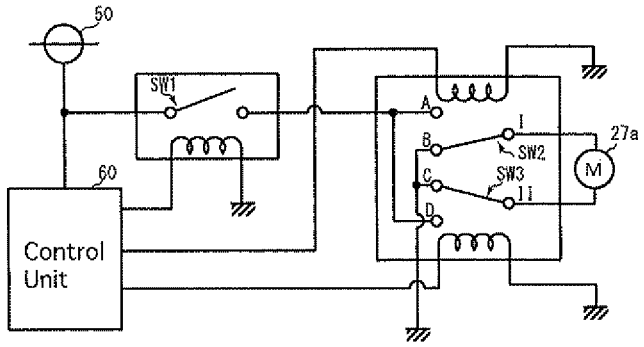
FIG. 14B—Circuit block diagram corresponding to state 2 of FIG. 13.
Figure 14C:
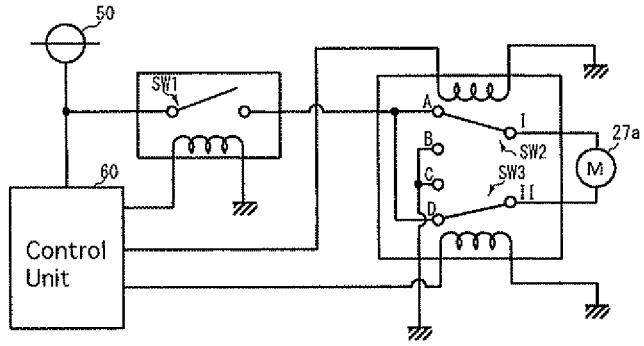
FIG. 14C—Circuit block diagram corresponding to state 3 of FIG. 13.
Figure 14D:
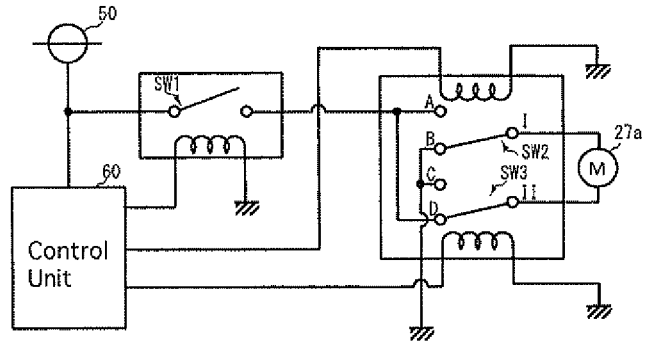
FIG. 14D—Circuit block diagram corresponding to state 4 of FIG. 13.
Figure 14E:
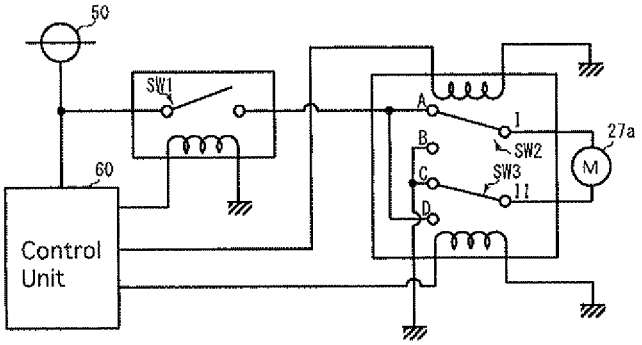
FIG. 14E—Circuit block diagram corresponding to state 5 of FIG. 13.

As shown in FIG. 14(E), when the first relay switch SW1 is in the ON state, points A and I of the second relay switch SW2 are conductive, and the points C and II of the third relay switch SW3 are conductive, the motor 27*a* rotates forwardly so that the back door 3 closes (state 5).

Figure 14F:
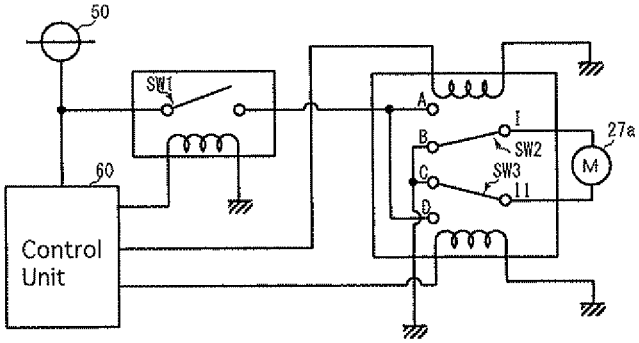
FIG. 14F—Circuit block diagram corresponding to state 6 of FIG. 13.
Figure 14G:
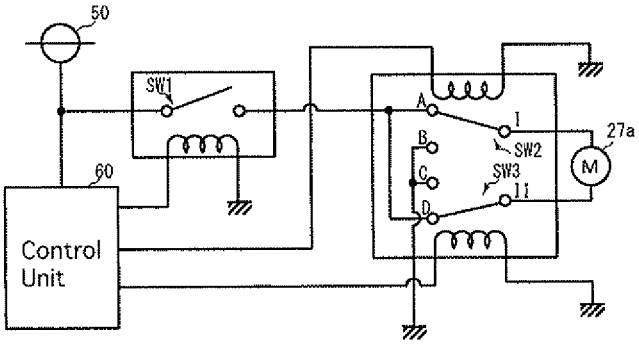
FIG. 14G—Circuit block diagram corresponding to state 7 of FIG. 13.

As shown in FIG. 14(F) and FIG. 14(G), when the first relay switch SW1 is in the ON state, points B and I of the second relay switch SW2 are conductive, and the points C and II of the third relay switch SW3 are conductive, or when the points A and I of the second relay switch SW2 are conductive and the points D and II of the third relay switch SW3 are conductive, the motor 27*a* does not rotate and the back door 3 does not open/close (states 6 and 7).

Figure 14H:
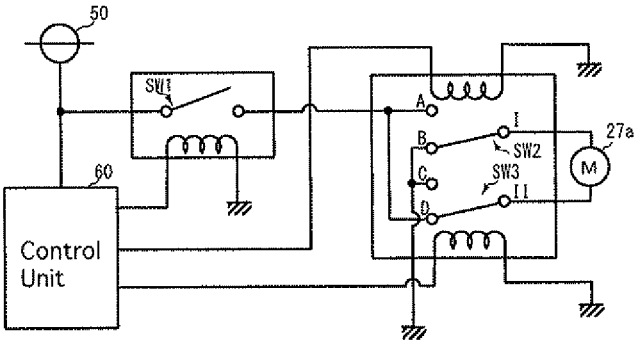
FIG. 14H—Circuit block diagram corresponding to state 8 of FIG. 13.

As shown in FIG. 14(H), when the first relay switch SW1 is in the ON state, the points B and I of the second relay switch SW2 are conductive, and the points D and II of the third relay switch SW3 are conductive, the motor 27*a* reversibly rotates so that the back door 3 is opened (state 8).

As shown in FIGS. 14(B), 14(C), 14(F) and 14(G), when the points B and I of the second relay switch SW2 are conductive and the points C and II of the third relay switch SW3 are conductive, or when the points A and I of the second relay switch SW2 are conductive and the points D and II of the third relay switch SW3 are conductive, a closed circuit is formed by the second relay switch SW2 and the third relay switch SW3, thereby forming a regeneration brake (states 2, 3, 6 and 7).

As shown in FIGS. 14(A), 14(D), 14(E) and 14(H), when the points A and I of the second relay switch SW2 are conductive and the points C and II of the third relay switch SW3 are conductive, or when the points B and I of the second relay switch SW2 are conductive and the points D and II of the third relay switch SW3 are conductive, an open circuit is formed by the second relay switch SW2 and the third relay switch SW3 (states 1, 4, 5 and 8).

The vehicle opening/closing body drive device according to the present invention is provided with a control unit 60 which controls the vehicle opening/closing body drive device by switching between ON/OFF states of the first through third relay switches SW1 through SW3 (which constitute a supplier or a switching device) based on the opening/closing operational conditions of the back door 3. An open-operational switch 70, to which an open instruction signal for instructing the opening of the back door 3 via the motor 27*a* is input, a temperature sensor (temperature detector) 80 which detects the temperature of the control unit 60, and a timer 90 which measures the time are connected to the control unit 60. The "opening/closing operational conditions of the back door 3" refer to, e.g., the inputting of the open instruction signal from the open-operational switch 70 to the control unit 60, or the detection of the half-latched state of the lock mechanism 10. Furthermore, the ratchet detection switch 30, the open-lever detection switch 31 and the sector gear detection switch 33 are connected to the control unit 60, and the ON/OFF states of these switches are input to the control unit 60.

The fundamental opening/closing control of the control unit 60, when a half-latched state of the lock mechanism 10 is detected, is to close the back door 3 by switching the first relay switch SW1 to the ON state, making the points A and I of the second relay switch SW2 conductive and making the points C and II of the third relay switch SW3 conductive (state 5), as shown in FIG. 14(E), by supplying a drive current to the motor 27*a* and driving the motor 27*a* forwardly.

Furthermore, the control unit 60, when an open instruction signal to open the back door 3 is input therein from the open-operational switch 70, opens the back door 3 by switching the first relay switch SW1 to the ON state, makes the points B and I of the second relay switch SW2 conductive, and makes the points D and II of the third relay switch SW3 conductive (state 8), as shown in FIG. 14(H), by supplying a drive current to the motor 27*a* and driving the motor 27*a* reversibly.

A characteristic feature of the controlling specifics of the control unit 60 is that the control unit 60 automatically determines whether or not any of the relay switches (the first through third relay switches SW1 through SW3) is frozen, and has the function of being able to automatically release a relay switch (of the first through third relay switches SW1 through SW3) from this frozen state upon determining such a frozen state. In order to achieve such a function, the control unit 60 is provided with a freeze determiner 61 and a freeze releaser 62.

When the motor 27*a* does not drive the specified amount in accordance with the opening/closing operational conditions of the back door (opening/closing body) 3 and the temperature of the control unit 60 detected by the temperature sensor 80 is less than or equal to a predetermined value (e.g., 0 degrees C.), the freeze determiner 61 determines that a relay switch (of the first through third relay switches SW1 through SW3) is frozen. Examples of "the motor 27*a* not driving the specified amount in accordance with the opening/closing operational conditions of the back door 3" are as follows:

(1) When the sector gear 26 cannot return to the initial position thereof from a position other than the initial position due to the motor 27*a* not being able to be driven forwardly, after the sector gear 26 has been moved from the initial position to a position other than the initial position by reversibly driving the motor 27*a* from the closure-completion stopped state (fully-closed state) of the back door 3 so that the back door 3 is in an opened state.

(2) In the closure-completion stopped state of the back door 3, when the output of any of the ratchet detection switch 30, the open-lever detection switch 31 or the sector gear detection switch 33 does not switch even upon the lapse of a predetermined period of time from the inputting of the open instruction signal of the back door 3 from the open-operational switch 70 to the control unit 60.

When the freeze determiner 61 determines that a relay switch(es) (the first relay switch SW1 through the third relay switch SW3) is frozen, the freeze releaser 62 releases the frozen state of each frozen relay switch (of the first through third relay switches SW1 through SW3) by intermittently supplying electric current for a predetermined number of times to each frozen relay switch (relay intermitting processes are performed) without forwardly/reversibly rotating the motor 27*a* (without supplying a drive current to the motor 27*a*).

Figure 15:
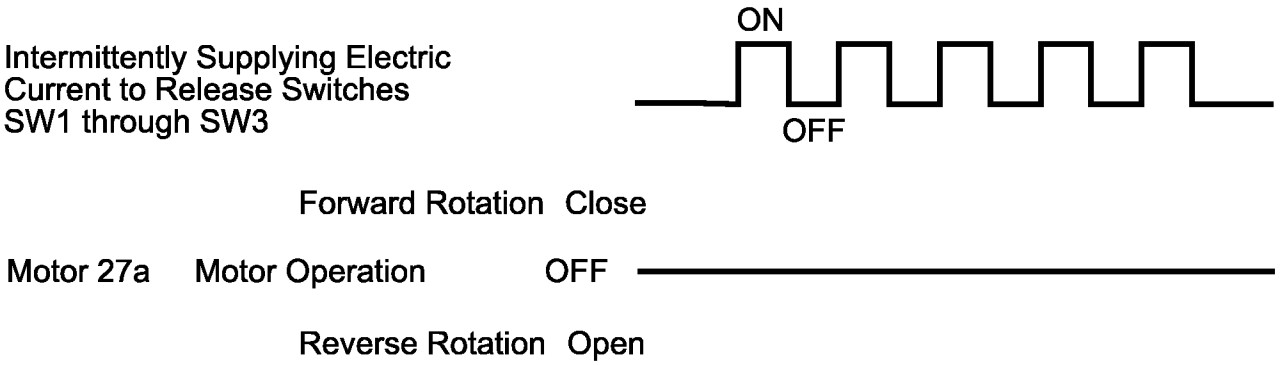
FIG. 15 shows the state of a single set of relay intermitting processes for intermittently supplying electric current to relay switches (first through third relay switches) without supplying a driving current to the motor.

More specifically, when the first relay switch SW1 is in the OFF state (states 1 through 4) as shown in FIGS. 14(A) through 14(D), the freeze releaser 62 intermittently supplies current (the supply of current is repetitively switched ON and OFF) to the second relay switch SW2 and the third relay switch SW3 by a predetermined time interval (e.g., 50 ms). Whereas, when the first relay switch SW1 is in an ON state, and a closed circuit is formed by the second relay switch SW2 and the third relay switch SW3, thereby forming a regeneration brake (states 6 and 7) as shown in FIGS. 14(F) and 14(G), the freeze releaser 62 intermittently supplies current (the supply of current is repetitively switched ON and OFF) to the first relay switch SW1 by a predetermined time interval (e.g., 50 ms). FIG. 15 shows current being intermittently supplied to each frozen relay switch (of the first through third relay switches SW1 through SW3) without supplying drive current to the motor 27*a*. The freeze releaser 62 repeats the intermittent supply of current by a predetermined number of times (e.g., 5 times). Hereinafter, the intermittent supply of current by a predetermined number of times will be referred to as "a single set of relay intermitting processes".

Every time the freeze releaser 62 performs a single set of relay intermitting processes, the freeze determiner 61 redetermines whether or not any of the relay switches (of the first through third relay switches SW1 through SW3) has frozen. If the freeze determiner 61 determines that the relay switch(es) (of the first through third relay switches SW1 through SW3) is still frozen, the freeze releaser 62 carries out another single set of relay intermitting processes. The freeze determiner 61 and the freeze releaser 62 repeat a freeze determining process and a freeze releasing process (a single set of relay intermitting processes) no fewer than a predetermined number of times (e.g., 5 times).

Figure 16:
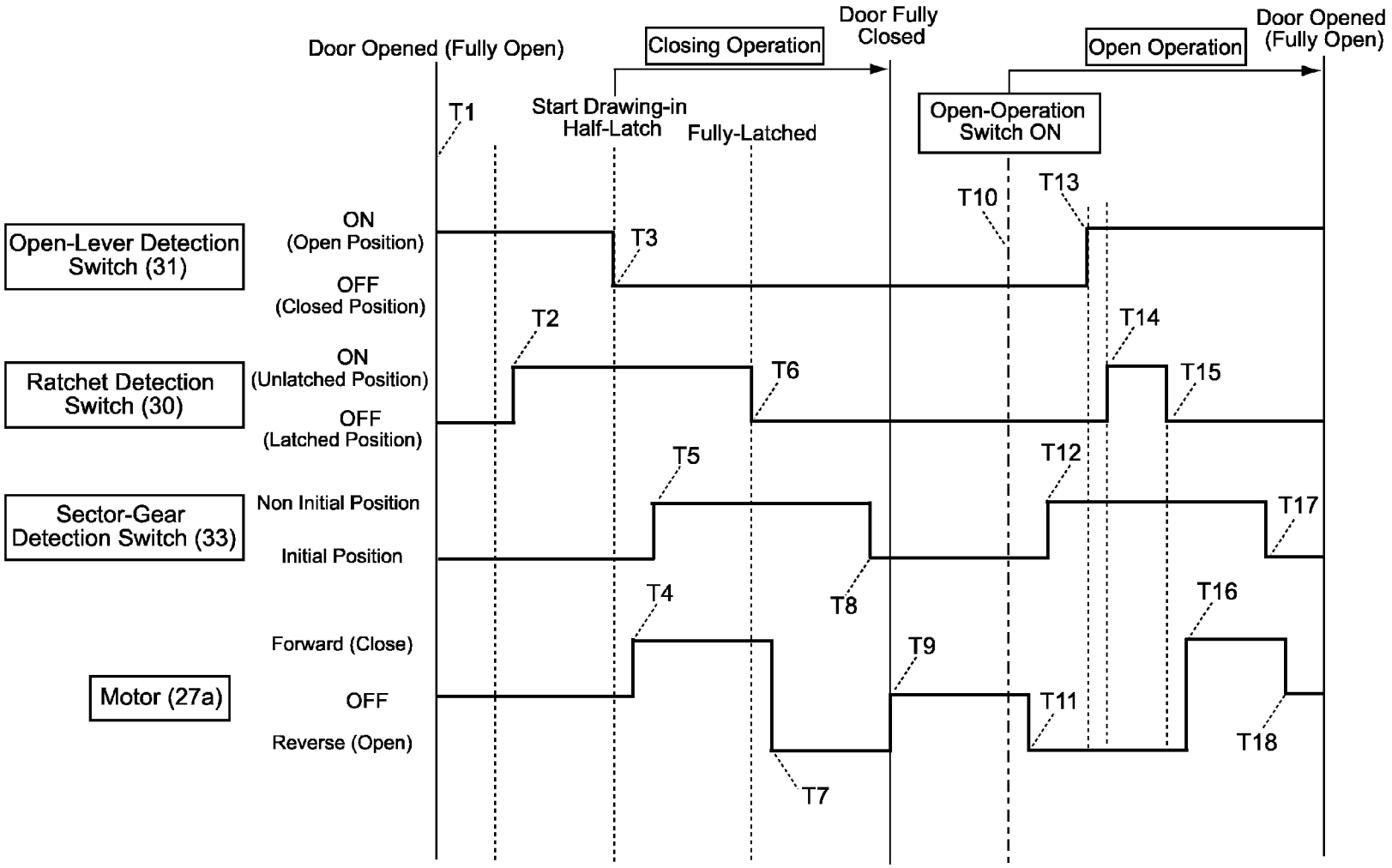
FIG. 16 is a timing chart of the operational states of the lock device.

Operations of the lock mechanism 10 having the above-described configuration will be described with reference to mainly FIGS. 8 through 10, and FIG. 16. FIGS. 8 through 10 show an embodiment of the mechanical operation of the lock mechanism 10, and FIG. 16 are timing charts showing the electrical control of the lock mechanism 10. In the mechanical diagrams, F1, F2, F3 and F4 respectively indicate the directions of biasing spring forces acting on the hook 12, the ratchet 13, the closing lever 20 and the open lever 23. The rotational direction of each of the following members is the rotational direction with respect to FIGS. 8 through 10. Furthermore, in regard to the driving direction of the motor 27*a*, the closing (locking) direction of the door is the forward direction and the door lock releasing direction is the reverse direction.

FIG. 8 shows the lock mechanism 10 with the back door 3 in an opened state (positioned close to the fully-closed position), as indicated by T1 in the timing chart of FIG. 16.

At this stage, the hook 12 is positioned at the striker release position so that the second leg portion 12*d* is positioned over the striker entry groove 11*a* and the first leg portion 12*c* is retracted from the striker entry groove 11*a*, and the ratchet 13 is rotated in a direction approaching the hook 12 to the latching position. As mentioned above, when the ratchet 13 is in the latching position, the switch operating member 13*f* does not press the switch leaf 30*a* of the ratchet detection switch 30, and the ratchet detection switch 30 is in a switch-OFF state. The positions of the hook 12 and the ratchet 13 are respectively maintained by the biasing force F1 of the torsion spring 16 and the biasing force F2 of the torsion spring 17. Specifically, the hook 12 is restricted from rotating any further in the F1 direction by a side surface thereof abutting against an upright wall 11*i* of the base plate 11, and the ratchet 13 is restricted from rotating any further in the F2 direction by the above-mentioned guide projection (not shown) abutting against an end of the ratchet guide groove 11*e*.

In the opened state, of the back door 3, in FIG. 8, since the closing lever 20 is held at the draw-in releasing position by a side surface of the closing lever 20 contacting the upright wall 11*i*, the control projection 21*c* of the interlinking lever 21 that is pivoted on the closing lever 20 about the pivot pin 22 is positioned upwardly away from the edge surface of the lower end of the interlinking-lever control groove 23*f* of the open lever 23, and the control projection 21*c* is restricted from rotating any further in the biasing F3 direction of the extension spring 25. At this stage, the biasing force F3 that the extension spring 25 applies against the closing lever 20 acts in a pressing direction of the control projection 21*c* of the interlinking lever 21 against the inner arc surface 23*f*1 of the interlinking-lever control groove 23*f*; and the interlinking lever 21 is held at the coupling disengaging position at which the interlinking lever 21 cannot engage with the coupling projection 12*h* of the hook 12 due to the control projection 21*c* abutting against the inner arc surface 23*f*1. Furthermore, the open-lever operating piece 26*c* of the sector gear 26 contacts the gear contact portion 23*h* of the open lever 23 while the closing lever operating portion 26*d* is positioned away from the second arm 20*c* of the closing lever 20, which is positioned at the draw-in release position. This position is the initial position of the sector gear 26 which the sector gear detection switch 33 detects by the pressing member 34, that is fixed to the sector gear 26, pressing the switch piece 33*a*. The open lever 23 is held at the open position by the rotation restriction wall 23*g* abutting against the coupling projection 12*h* of the hook 12 so that the rotation of the open lever 23 is restricted in the direction of the biasing force F4 of the extension spring 25. As mentioned above, when the open lever 23 is at the open position, the switch operating member 23*e* presses against the switch leaf 31*a* of open-lever detection switch 31, so that the open-lever detection switch 31 is in a switched ON state. Thereafter, the electronic control unit 32 detects the open state of the back door 3 by an input-signal combination of the open-lever detection switch 31 being ON and the ratchet detection switch 30 being OFF.

When the striker S enters into the striker entry groove 11*a* and presses against the second leg portion 12*d* in the closing operation of the back door 3, the hook 12 holds the striker S inside the striker holding groove 12*b* while rotating in the counterclockwise direction from the striker release position of FIG. 8 toward the draw-in commencement position of FIG. 10 against the biasing force F1 of the torsion spring 16. Subsequently, the ratchet pressure projection 12*f* of the hook 12 pushes into the stepped portion 13*e* of the ratchet 13 and the ratchet 13 rotates, against the biasing force F2 of the torsion spring 17, in the clockwise direction from the latching position of FIG. 8 to the unlatching position shown in FIG. 10. When the ratchet 13 rotates to the unlatching position, the switch operating member 13*f* presses against the switch leaf 30*a*, and the ratchet detection switch 30 switches from OFF to ON (T2).

The rotation restriction wall 23*g* of the open lever 23 has a predetermined length in the elongated direction of the second arm 23*c*; and until immediately before the hook 12 reaches the draw-in commencement position of FIG. 9 from the striker release position of FIG. 8, the rotation restriction wall 23*g* abuts against the coupling projection 12*h* of the hook 12 and the open lever 23 is restricted from rotating toward the closed position (clockwise direction) to be continuously held at the open position. Thereafter, upon the hook 12 reaching the draw-in commencement position of FIG. 9, the coupling projection 12*h* of the hook 12 deviates from the position facing the rotation restriction wall 23*g* thereby releasing the rotational restriction, so that the open lever 23 rotates to the closing position shown in FIG. 9 by the biasing force F4 of the extension spring 25 (T3). When the open lever 23 is rotated to the closing position, since the outer arc surface 23*f*2 of the open lever 23 pushes the control projection 21*c* of the interlinking lever 21 toward the closing position, the interlinking lever 21 rotates in the clockwise direction about the pivot pin 22 by the biasing force F3 of the extension spring 25, and moves from the coupling disengaging position shown in FIG. 8 to the coupling position of FIG. 9. Accordingly, since the coupling projection 12*h* of the hook 12 comes in contact with the base of the coupling recess 21*b* of the interlinking lever 21, the hook 12 is held in the draw-in commencement position by the interlinking lever 21. This state corresponds to the half-latched state shown in FIG. 9. During the transition of the lock mechanism 10 from the door-open state shown in FIG. 8 to the half-latched state shown in FIG. 9 (including the time the hook 12 is in the striker releasing position and the time the hook 12 is in the draw-in commencement position), the side surface of the closing lever 20 continues to contact the upright wall 11*i*, so that the closing lever 20 is held in the draw-in releasing position even when the lock mechanism 10 is in the half-latched state. The rotation of the opening lever 23 to the closing position causes the switch operating piece 23*e* to stop pressing the switch leaf 31*a*, thus causing the opening lever detection switch 31 to be turned OFF from the ON state (T3). Thereafter, the electronic control unit 32 detects the half-latched state of the back door 3 from a combination of an input signal indicating an ON state of the ratchet detection switch 30 and an input signal indicating an OFF state of the opening lever detection switch 31.

The interlinking lever 21 and the opening lever 23 are both rotated in the clockwise direction when the back door 3 moves from the open state (a state where it is positioned in the vicinity of the fully-closed position) shown in FIG. 8 to the half-latched state shown in FIG. 9; however, during such clockwise rotation of the interlinking lever 21 and the opening lever 23, the control projection 21*c* of the interlinking lever 21 relatively changes the position thereof in the interlinking-lever control groove 23*f* in the widthwise direction thereof to change to the state (shown in FIG. 9) in which the control projection 21*c* is in contact with the outer arc surface 23*f*2. Additionally, in this state, the interlinking lever 21 is prevented from rotating toward the coupling disengaging position by the contacting relationship between the control projection 21*c* and the outer arc surface 23*f*2.

Upon the detection of the half-latched state, the electronic control unit 32 drives the motor 27*a* of the motor unit 27 in the forward direction (T4). Thereupon, due to the engagement between the pinion 27*b* and the gear portion 26*b*, the sector gear 26 is rotated in the clockwise direction with respect to FIG. 9 (T5), and this rotation of the sector gear 26 causes the closing lever operating portion 26*d* to press the second arm 20*c* of the closing lever 20 to thereby rotate the closing lever 20 in the counterclockwise direction from the draw-in releasing position shown in FIG. 9 to the draw-in position shown in FIG. 10. This also causes the hook 12, which is integrated with the closing lever 20 via the interlinking lever 21 (and is prevented from rotating toward the striker releasing position by the coupling recess 21*b*), to rotate in the counterclockwise direction from the draw-in commencement position shown in FIG. 9 to the striker holding position shown in FIG. 10, so that the striker S is drawn deeply into the striker entry groove 11*a* by the striker holding groove 12*b* of the hook 12. At this stage, the interlinking lever 21 moves integrally with the closing lever 20 about the pivot pin 14 while making the control projection 21*c* slide on the outer arc surface 23*f*2 of the interlinking-lever control groove 23*f* (at this time the rotational center of the outer arc surface 23*f*2 is coincident with the pivot pin 14) with the coupling recess 21*b* and the coupling projection 12*h* remaining engaged with each other. Additionally, during the time the opening lever 23 is held in the closing position, the interlinking lever 21 is prevented from rotating (rotating on the pivot pin 22) in a direction (toward the coupling disengaging position) to release the engagement between the coupling recess 21*b* and the coupling projection 12*h* by the engagement between the outer arc surface 23*f*2 and the control projection 21*c*. In other words, the outer arc surface 23*f*2 functions as a guide surface which determines the path of the rotational movement of the interlinking lever 21 during the closing operation of the back door 3 from the half-latched state.

During the rotation of the combination of the hook 12 and the closing lever 20 in the draw-in direction of the striker S from the half-latched state shown in FIG. 9, the circular arc surface 12*g* that is formed at the end of the second leg portion 12*d* of the hook 12 comes in sliding contact with the circular-arc surface portion 13*d* of the ratchet 13, and the ratchet 13 is held in the unlatching position against the biasing force F2 of the torsion spring 17 in a manner similar to the case of the half-latched state shown in FIG. 9. During this stage, the opening lever 23 is also held in the closing position in a manner similar to the case in the half-latched state. Namely, a state where the ratchet detection switch 30 and the opening lever detection switch 31 are ON and OFF, respectively, continues. Thereafter, a rotation of the hook 12 to the striker holding position shown in FIG. 10 causes the circular arc surface 12*g* to escape upward from a position facing the circular-arc surface portion 13*d* to thereby release the prevention of rotation of the ratchet 13 so that the ratchet 13 rotates toward the latching position (in the counterclockwise direction) from the unlatching position by the biasing force F2 of the torsion spring 17, so that the rotation-restriction stepped portion 13*c* is engaged with the ratchet-engaging stepped portion 12*e* as shown in FIG. 10. Due to this engagement between the rotation-restriction stepped portion 13*c* and the ratchet-engaging stepped portion 12*e*, the hook 12 is prevented from rotating in the direction toward the striker releasing position, so that the lock mechanism 10 comes into the fully-latched state (the door fully-closed state), in which the striker S is completely held in the inner part of the striker entry groove 11*a*. The counterclockwise rotation of the ratchet 13 when the rotation-restriction stepped portion 13*c* is brought into engagement with the ratchet-engaging stepped portion 12*e* causes the switch operating piece 13*f* to stop pressing the switch leaf 30*a*, thus causing the ratchet detection switch 30 to be turned OFF from the ON state (T6). Namely, each of the ratchet detection switch 30 and the opening lever detection switch 31 is turned OFF, thereby the fully-latched state being detected.

Upon the detection of the fully-latched state, the electronic control unit 32 continues to drive the motor 27*a* in the forward direction by a predetermined overstroke amount in order to ensure a latched state and thereafter drives the motor 27*a* reversely in the door opening direction (T7). This reverse driving of the motor 27*a* is for returning the sector gear 26 which has been rotated to the position shown in FIG. 10 by the closing operation to the initial position shown in FIG. 8, and upon the sector gear detection switch 33 detecting, by the pressure of the pressing member 34 against the switch leaf 33*a*, that the sector gear 26 has returned to the initial position thereof (T8), the motor 27*a* is stopped (T9). In this state in which the motor is stopped, the closing lever operating portion 26*d* is disengaged from the second arm 20*c*, so that the pressure force on the closing lever 20 from the sector gear 26 is released. However, as described above, the hook 12 is prevented from rotating in the clockwise direction with respect to FIG. 10 (in the direction toward the striker releasing position) due to the engagement thereof with the ratchet 13, and the closing lever 20 which is integrated with the hook 12 via the interlocking lever 21 is also prevented from rotating in the clockwise direction (in the direction toward the draw-in releasing position) against the biasing force F4 of the extension spring 25. In other words, the fully-latched state is maintained.

Upon the opening operation switch 70 (FIG. 12) which is electrically connected to the electronic control unit 32 being turned ON (an open instruction signal being inputted) in the fully-latched state (T10), the motor 27*a* is driven in the reverse direction (T11) to rotate the sector gear 26 in the counterclockwise direction from the initial position shown in FIG. 8 (T12). Thereupon, the opening lever operating piece 26*c* presses the gear contact portion 23*h*, which causes the opening lever 23 to rotate counterclockwise from the closing position shown in FIG. 10 toward the opening position against the biasing force F4 of the extension spring 25 so that the opening lever detection switch 31 is turned ON from the OFF state (T13). This counterclockwise rotation of the opening lever 23 causes the inner arc surface 23*f*1 of the interlinking-lever control groove 23*f* to press the control projection 21*c*, thus causing the interlinking lever 21 to rotate counterclockwise (toward the coupling disengaging position) about the pivot pin 22. Thereupon, this rotation of the interlinking lever 21 causes the engagement between the coupling recess 21*b* and the coupling projection 12*h* to be released, to thereby release the coupling (via the interlocking lever 21) between the hook 12 and the closing lever 20 from each other. In addition, the ratchet pressure projection 21*d* of the interlinking lever 21 that rotates in the counterclockwise direction presses the pressed piece 13*g* of the ratchet 13 to rotate the ratchet 13 in the clockwise direction from the latching position to the unlatching position against the biasing force F2 of the torsion spring 17 (T14).

This rotation of the ratchet 13 to the unlatching position causes the engagement between the rotation-restriction stepped portion 13*c* and the ratchet-engaging stepped portion 12*e*, i.e., the prevention of rotation of the hook 12, to be released, which causes the hook 12 to rotate toward the striker releasing position shown in FIG. 8 from the striker holding position shown in FIG. 10 by the biasing force F1 of the torsion spring 16. The closing lever 20, the engagement of which with the hook 12 has been released, is also rotated in the clockwise direction toward the draw-in releasing position shown in FIGS. 8 and 9 from the draw-in position shown in FIG. 10 by the biasing force F4 of the extension spring 25; in accordance with this rotation, the control projection 21*c* of the interlinking lever 21 moves in the interlinking-lever control groove 23*f* toward the lower end thereof while sliding on the inner arc surface 23*f*1. Additionally, during the time the opening lever 23 is held in the opening position, the interlinking lever 21 is prevented from rotating (rotating about the pivot pin 22) in a direction (toward the coupling position) to make the coupling recess 21*b* and the coupling projection 12*h* re-engaged with each other by the engagement between the inner arc surface 23*f*1 and the control projection 21*c*. In other words, the inner arc surface 23*f*1 functions as a guide surface which determines the path of the rotational movement of the interlinking lever 21 during the opening operation from the fully-latched state.

Upon the interlinking lever 21 moving downward by a predetermined amount of movement following the rotation of the closing lever 20 toward the draw-in releasing position, the pressure of the ratchet pressure projection 21*d* of the interlinking lever 21 against the pressed piece 13*g* of the ratchet 13 in a direction toward the unlatching position is released. However, during the time until the hook 12 reaches the striker releasing position shown in FIG. 8 from the moment the engagement between the rotation-restriction stepped portion 13*c* and the ratchet-engaging stepped portion 12*e* is released, the circular arc surface 12*g* of the second leg portion 12*d* of the hook 12 presses the circular-arc surface portion 13*d* of the ratchet 13 so that the ratchet 13 continues to be held in the unlatching position against the biasing force F2 of the torsion spring 17. More specifically, the amount of rotation of the closing lever 20 from the draw-in position (FIG. 10) to the draw-in releasing position (FIG. 9) is substantially the same as the amount of rotation of the hook 12 from the striker holding position (FIG. 10) to the draw-in commencement position (FIG. 9), and when performing the opening operation, the pressure of the interlinking lever 21 on the ratchet 13 toward the unlatching position is released at a stage before the closing lever 20 reaches the draw-in releasing position shown in FIG. 9. On the other hand, the pressure of the second leg portion 12*d* of the hook 12 on the ratchet 13 in a direction toward the unlatching position continues for a longer period of time than the pressure of the interlinking lever 21 on the ratchet 13, and it is not until the engagement between the circular arc surface 12*g* and the circular-arc surface portion 13*d* is released, upon the ratchet pressure projection 12*f* moving over the stepped portion 13*e* of the ratchet 13 after the hook 12 reaches the striker releasing position (FIG. 8), that the ratchet 13 is allowed to rotate to the latching position. Thereafter, the ratchet 13 rotates and returns to the latching position from the unlatching position by the biasing force F2 of the torsion spring 17 (T15) for the first time after the aforementioned allowance of rotation of the ratchet 13 takes place. Namely, the aforementioned signals representing a door-open state of the back door 3 that respectively indicate an OFF state of the ratchet detection switch 30 and an ON state of the opening lever detection switch 31 are not input until the hook 12 reaches the striker releasing position.

Upon the detection of the door-open state of the back door 3, the electronic control unit 32 continues to drive the motor 27*a* in the reverse direction by a predetermined overstroke amount in order to ensure a latch released state, and thereafter drives the motor 27*a* forwardly in the door closing direction (T16). This forward driving of the motor 27*a* is for returning the sector gear 26, which has been rotated counterclockwise from the initial position shown in FIG. 8 when performing the opening operation, to the initial position, and upon the sector gear detection switch 33 detecting that the sector gear 26 has returned to the initial position thereof (T17) the motor 27*a* is stopped (T18), the lock mechanism 10 returns to the door-open state of the back door 3 shown in FIG. 8.

Figure 17:
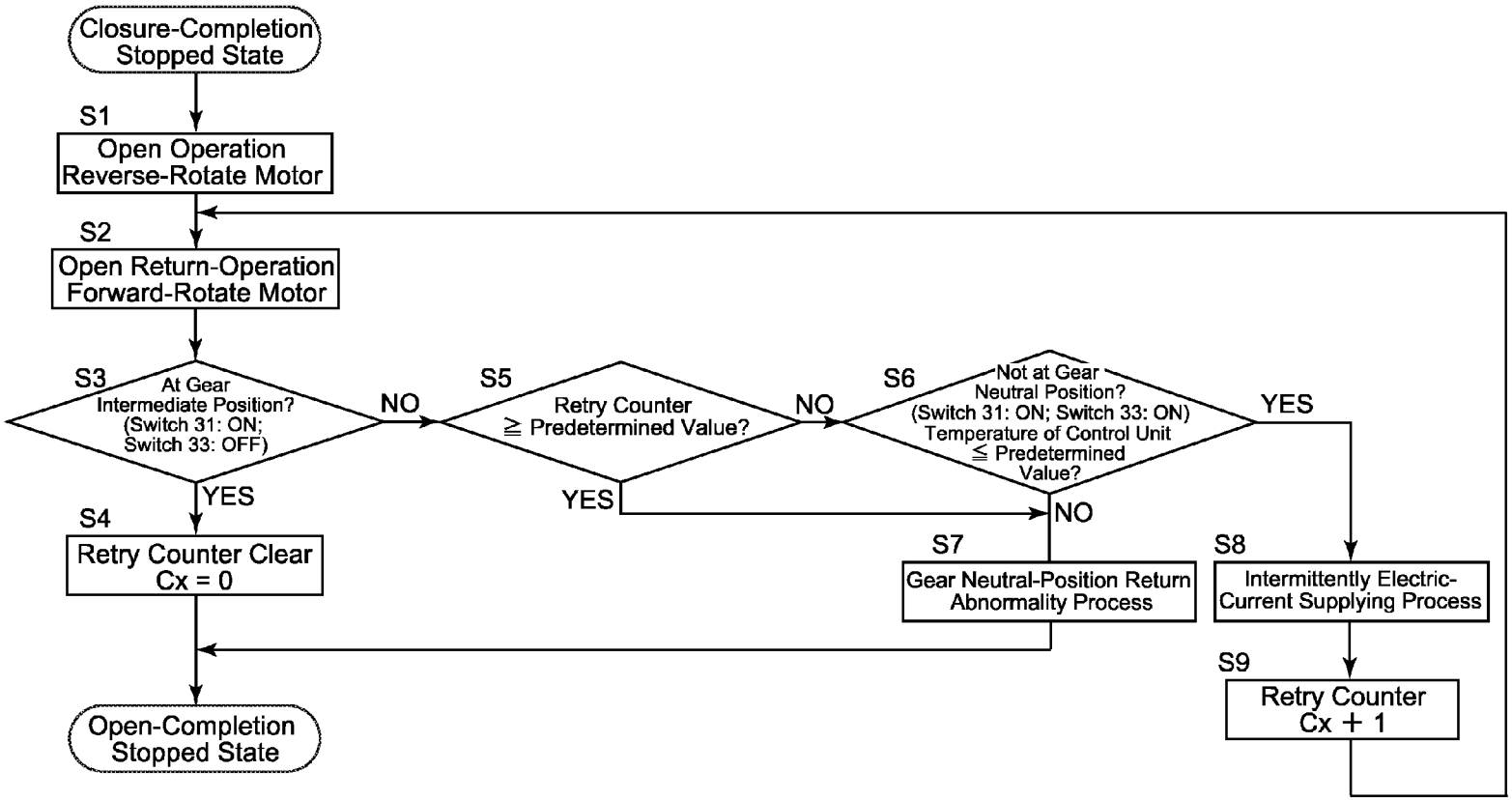
FIG. 17 is a flowchart which explains the operations of the first embodiment of the drive device for an opening/closing body according to the present invention.

The following is an explanation of the operations according to the first embodiment of the drive device for a vehicle opening/closing body, according to the present invention, with reference to the flowchart of FIG. 17.

FIG. 17 shows an operation for when electrical contact of the second relay switch SW2 and/or the third relay switch SW3, which constitute a "switching device", freeze and cannot be switched, and for when the forward/reverse rotational direction of the motor 27*a* cannot be switched by switching the direction of supply of drive current generated from the battery 50.

The "motor 27*a* does not drive the specified amount in accordance with the opening/closing operational conditions of the back door 3" in the embodiment of FIG. 17 refers to when the sector gear 26 cannot return to the initial position thereof from a position other than the initial position due to the motor 27*a* not being able to be driven forwardly, after the sector gear 26 has been moved from the initial position to a position other than the initial position so that the back door 3 is in an opened state by reversibly driving the motor 27*a* from the closure-completion stopped state (fully-closed state) of the back door 3.

First of all, in step S1, the control unit 60 reversibly drives the motor 27*a* in the closure-completion stopped state (fully-closed state) of the back door 3 by inputting an open instruction signal from the open-operational switch 70 (T11 of FIG. 16). Subsequently, the sector gear 26 rotates counterclockwise from the initial position shown in FIG. 8, and the sector gear detection switch 33 detects that the sector gear 26 is at a position other than the initial position (T12 of FIG. 16). Furthermore, the open-lever operating piece 26*c* presses against the gear contact portion 23*h*, the open lever 23 rotates in the counterclockwise direction from the closed position of FIG. 10 to the open position, against the biasing force F4 of the extension spring 25, and the open-lever detection switch 31 switches from the OFF state to the ON state (T13 of FIG. 16). When the back door 3 is further opened, the ratchet detection switch 30 switches OFF and the open-lever detection switch 31 switches ON, and the above-mentioned open state of the back door 3 is detected (T14 and T15 of FIG. 16).

Subsequently, in step S2, since the open state of the back door 3 has been detected, the control unit 60 continues to drive the motor 27*a* in the reverse direction by a predetermined overstroke amount in order to ensure a latch released state, and thereafter drives the motor 27*a* forwardly in the closing direction (T16 of FIG. 16). In other words, the control unit 60 switches from a state in which the points B and I of the second relay switch SW2 are conductive to a state in which the points A and I of the second relay switch SW2 are conductive, and switches from a state in which the points D and II of the third relay switch SW3 are conductive to a state in which the points C and II of the third relay switch SW3 are conductive (switches from the state of FIG. 14(H) to the state of FIG. 14(E)).

Subsequently, in step S3, the control unit 60 detects whether or not the sector gear 26 is at the gear neutral position, in which the sector gear 26 has returned to the initial position, by detecting whether or not the open-lever detection switch 31 is in the ON state and the sector gear detection switch 33 is in the OFF state.

If the sector gear 26 has returned to the gear neutral position (step S3: YES), the sector gear 26, which was rotated in the counterclockwise direction from the initial position shown in FIG. 8, returns to the initial position during the open operation (T17 of FIG. 16), the motor 27*a* stops (T18 of FIG. 16), the lock mechanism 10 returns to the open state of the back door 3 shown in FIG. 8, and the back door 3 enters an open-completion stopped state. At this stage, in step S4, a retry counter for the relay intermitting process is cleared. The processes of steps S1 through S4 are normal state processes for when the electrical contacts of the second relay switch SW2 and/or the third relay switch SW3, which constitute a "switching device", are not frozen.

Whereas, if the sector gear 26 has not returned to the gear neutral position (step S3: NO), there is a risk of the sector gear 26, which was rotated in the counterclockwise direction from the initial position shown in FIG. 8, not having returned to the initial position due to the electrical contacts of the second relay switch SW2 and/or the third relay switch SW3, which constitute a "switching device", freezing and not being able to be switched.

Consequently, the freeze determiner 61 of the control unit 60 waits for a predetermined period of time to lapse at step S6 for as long as the retry counter is not greater or equal to a predetermined value (e.g., 5) (step S5: NO), and it is again detected whether or not the sector gear 26 has returned to the initial position (which is the gear neutral position) by detecting whether or not the open-lever detection switch 31 is ON and the sector gear detection switch 33 is ON, while it is detected whether or not the temperature of the control unit 60 is less than or equal to a predetermined value (0 degrees C.) by the temperature sensor 80.

If the sector gear 26 has returned to the gear neutral position (step S6: NO), the sector gear 26, which was rotated in the counterclockwise direction from the initial position shown in FIG. 8, returns to the initial position during the open operation (T17 of FIG. 16), the motor 27*a* stops (T18 of FIG. 16), the lock mechanism 10 returns to the open state of the back door 3 shown in FIG. 8, and the back door 3 enters an open-completion stopped state. Furthermore, when the temperature of the control unit 60 is greater than a predetermined value (e.g., 0 degrees C.) (step S6: NO), control performs a gear neutral-position return abnormality process at step S7. The gear neutral-position return abnormality process is a process in which the open-lever detection switch 31 or the sector gear detection switch 33 is examined, since there is a risk of the control unit 60 determining that the sector gear 26 has not returned to the gear neutral position, due to, e.g., the open-lever detection switch 31 or the sector gear detection switch 33 malfunctioning even though the sector gear 26 has actually returned to the gear neutral position.

Whereas, if the sector gear 26 has not returned to the gear neutral position while the temperature of the control unit 60 is less than or equal to a predetermined value (e.g., 0 degrees C.) (step S6: YES), the freeze determiner 61 of the control unit 60 determines that a relay switch(es) (of first through third relay switches SW1 through SW3) has frozen.

Thereafter, at step S8, the freeze releaser 62 of the control unit 60 supplies an intermitting current by a predetermined number of times to the frozen relay switch(es) (of the first through third relay switches SW1 through SW3) without forwardly/reversibly rotating the motor 27*a* (without supplying drive current to the motor 27*a*), to thereby perform a single set of relay intermitting processes to release the frozen state of the frozen relay switch(es) (of the first through third relay switches SW1 through SW3).

More specifically, when the first relay switch SW1 is in the OFF state (states 1 through 4) as shown in FIGS. 14(A) through 14(D), the freeze releaser 62 intermittently supplies current (the supply of current is repetitively switched ON and OFF) to the second relay switch SW2 and the third relay switch SW3 by a predetermined time interval (e.g., 50 ms). Alternatively, when the first relay switch SW1 is in an ON state and a closed circuit is formed by the second relay switch SW2 and the third relay switch SW3, thereby forming a regeneration brake (states 6 and 7) as shown in FIGS. 14(F)

and 14(G), the freeze releaser 62 intermittently supplies current (the supply of current is repetitively switched ON and OFF) to the first relay switch SW1 by a predetermined time interval (e.g., 50 ms).

As shown in FIG. 15, when a single set of relay intermitting processes are carried out at step S8, the control unit 60 the retry counter of the relay intermitting processes is incremented by 1 (step S9).

The control unit 60 repeats the processes at steps S2, S3, S5, S6, S8 and S9 by a predetermined number of times (e.g., five times). In other words, every time the freeze releaser 62 carries out a single set of relay intermitting processes, the freeze determiner 61 determines again whether or not a relay switch(es) (of the first through third relay switches SW1 through SW3) has frozen. If the freeze determiner 61 determines that the frozen relay switch(es) (of the first through third relay switches SW1 through SW3) is still frozen, the freeze releaser 62 carries out another single set of relay intermitting processes. The freeze determiner 61 and the freeze releaser 62 repeat the freeze determining process and the freeze releasing process (a single set of relay intermitting processes) a predetermined number of times (e.g., 5 times). Thereafter, upon the retry counter becoming greater than or equal to a predetermined value (e.g., 5) (step S5: YES), the gear neutral-position return abnormality process at step S7 is performed.

Hereinafter, operations of a second embodiment of a vehicle opening/closing body drive device of the present invention will be explained while referring to the flowchart of FIG. 18.

Figure 18:
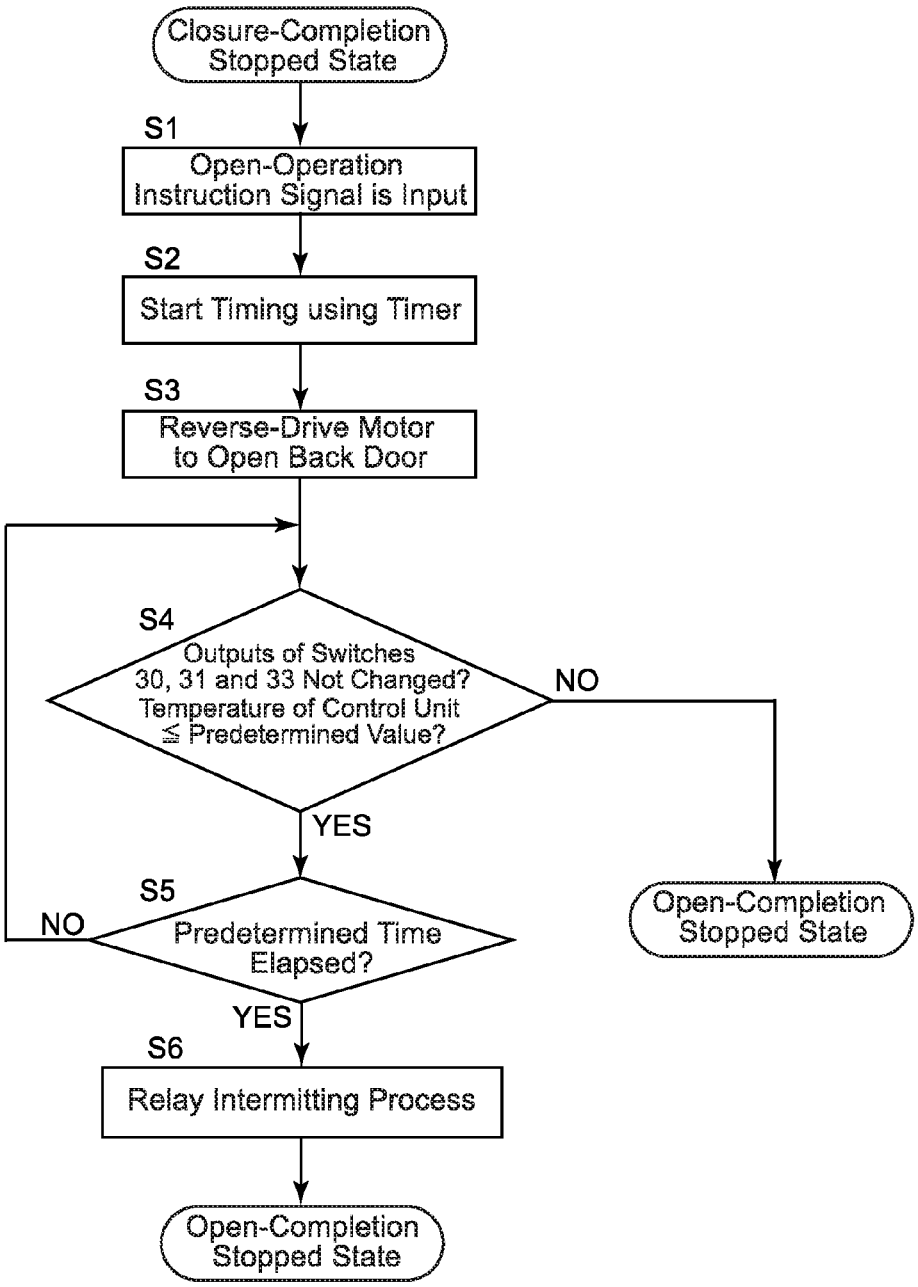
FIG. 18 is a flowchart which explains the operations of the second embodiment of the drive device for an opening/closing body according to the present invention.

FIG. 18 indicates the operations for when the drive current generated at the battery 50 cannot be supplied to the motor 27*a* due to all or some of the electrical contacts of the first through third relay switches SW1 through SW3, which constitute the "supplier", freezing and not being able to switch.

The "motor 27*a* does not drive the specified amount in accordance with the opening/closing operational conditions of the back door 3" in the embodiment of FIG. 18 refers to when the output of the ratchet detection switch 30, the open-lever detection switch 31 or the sector gear detection switch 33 cannot be switched even upon a predetermined amount of time lapsing from the inputting of the open instruction signal of the back door 3 to the control unit 60 from the open-operational switch 70 in the closure-completion stopped state (fully-closed state) of the back door 3.

First of all, in step S1, the open instruction signal for the back door 3 is inputted to the control unit 60 from the open-operational switch 70 in the closure-completion stopped state (fully-closed state) of the back door 3. Subsequently, in step S2, the control unit 60 starts measuring the time elapsed from when the open instruction signal is inputted using the timer 90.

Concurrently, in step S3, the control unit 60 tries to achieve the state shown in FIG. 14(H), which the first relay switch SW1 is switched to the ON state, the points B and I of the second relay switch SW2 are made conductive, and the points D and II of the third relay switch SW3 are made conductive, in order to reversibly drive the motor 27*a* to open the back door 3.

In steps S4 and S5, the control unit 60 determines whether or not the output of the ratchet detection switch 30, the open-lever detection switch 31 or the sector gear detection switch 33 has switched (T2, T3 or T5 of FIG. 16), and whether or not the temperature of the control unit 60 is less than or equal to a predetermined value (e.g., 0 degrees C.) via the temperature sensor 80, before a predetermined amount of time has elapsed from when the open instruction signal was inputted.

Before the lapsing of the predetermined amount of time from when the open instruction signal was inputted, when the output of the ratchet detection switch 30, the open-lever detection switch 31 or the sector gear detection switch 33 has switched, or the temperature of the control unit 60 is greater than the predetermined value (e.g., 0 degrees C.) (step S4: NO; step S5: NO), the freeze determiner 61 determines that the relay switches (the first through third relay switches SW1 through SW3) are not frozen. Thereafter, the back door 3 opens, and eventually enters an open-completion stopped state.

Whereas, if the predetermined amount of time from when the open instruction signal was inputted lapses in a state where the output of the ratchet detection switch 30, the open-lever detection switch 31 or the sector gear detection switch 33 has not switched, and the temperature of the control unit 60 is equal to or less than the predetermined value (e.g., 0 degrees C.) (step S4: YES; step S5: YES), the freeze determiner 61 determines that a relay switch(es) (of the first through third relay switches SW1 through SW3) has frozen.

Subsequently, in step S6, the freeze releaser 62 carries out a relay intermitting process for releasing the frozen state of the relay switch(es) (of the first through third relay switches SW1 through SW3) by intermittently supplying current a predetermined number of times to the frozen relay switch(es) (of the first through third relay switches SW1 through SW3) without forwardly/reversibly rotating the motor 27*a* (without supplying a drive current to the motor 27*a*).

More specifically, as shown in FIGS. 14(A) through 14(D), the freeze releaser 62 supplies current intermittently (by repeatedly switching the supply current ON and OFF) to the second relay switch SW2 and the third relay switch SW3 for a predetermined period of time (e.g., 50 ms) when the first relay switch SW1 is in an OFF state (the first through fourth states). Alternatively, as shown in FIGS. 14(F) and 14(G), the freeze releaser 62 intermittently supplies current (by repeatedly switching the supply current ON and OFF) to the first relay switch SW1 for a predetermined period of time (e.g., 50 ms) when the first relay switch SW1 is in the ON state, and a closed circuit is formed by the second relay switch SW2 and the third relay switch SW3, thereby forming a regeneration brake (states 6 and 7).

Upon the frozen state of the relay switch(es) (of the first through third relay switches SW1 through SW3) being released, the back door 3 opens, and eventually enters an open-completion stopped state.

As described above, according to the vehicle opening/closing body drive device according to the illustrated embodiment, the control unit 60 is provided with a freeze determiner 61, which determines that a relay switch(es) (SW1, SW2 and SW3) is frozen when the motor 27*a* does not drive the specified amount in accordance with the opening/closing operational conditions of the back door 3, and the temperature of the control unit 60 detected by the temperature sensor 80 is less than or equal to a predetermined value; and a freeze releaser 62 which releases the frozen state of the relay switch(es) (SW1, SW2 and SW3) by intermittently supplying current a predetermined number of times to each frozen relay switch (SW1, SW2 and SW3) without supplying drive current to the opening/closing-body motor 27*a*, when the freeze determiner 61 determines that a relay switch(es) (SW1, SW2 or SW3) is frozen. Accordingly, a malfunction due to the electrical contacts of the relay switches (SW1, SW2 and SW3) freezing can be prevented. Moreover, since the opening/closing drive motor 27*a* can be prevented from immediately starting to drive upon the frozen relay switch(es) (SW1, SW2 and/or SW3) being released, operational stability can be improved.

In each of the above illustrated embodiments, although a vehicle opening/closing body drive device in which an opening/closing body drive device of the present invention is applied to a vehicle door (back door 3) closure device has been described, the present invention is not limited thereto. The vehicle opening/closing body drive device of the present invention can be applied to, e.g., various types of vehicle opening/closing body drive devices, such as a power trunk lid or a swing door, etc. Furthermore, the opening/closing body drive device of the present invention can also be applied to various other types of opening/closing body drive devices other than those for vehicle use.

Each of the above-described embodiments, in a single set of relay intermitting processes, describes the freeze releaser 62 repeating the intermitting supply of current to the relay switch(es) (of the first through third relay switches SW1 through SW3) five times, without a drive current being supplied to the motor 27*a*. However, the number of times the intermitting current is supplied to the relay switch(es) (of the first through third relay switches SW1 through SW3) in the single set of relay intermitting processes is not limited to 5 times, and can be 1 time, or 2 or more times.

INDUSTRIAL APPLICABILITY

The opening/closing body drive device of the present invention is suitable for use in a drive device for a vehicle opening/closing body such as, e.g., a vehicle door (back door), a power trunk lid, or a swing door, etc.

REFERENCE SIGNS LIST

1 Vehicle body
2 Rear opening (opening)
3 Back door (opening/closing body)
10 Lock mechanism
11 Base plate
11*a* Striker entry groove
11*j* Support projection
11*k* Annular stepped portion
12 Hook
12*b* Striker holding groove
12*e* Ratchet-engaging stepped portion
12*f* Ratchet pressure projection
12*g* Circular arc surface
12*h* Coupling projection
13 Ratchet
13*c* Rotation-restriction stepped portion
13*d* Circular-arc surface portion
13*e* Stepped portion
13*f* Switch operating member
13*g* Pressed member
16 Torsion spring
17 Torsion spring
18 Stopper member
20 Closing lever
20*b* First arm
20*c* Second arm
20*d* Recess
20*g* Stopper surface
21 Interlinking lever
21*b* Coupling recess
21*c* Control projection
21*d* Ratchet pressure projection
23 Open lever
23*b* First arm
23*c* Second arm
23*d* Handle interlinking hole
23*e* Switch operating member
23*f* Interlinking-lever control hole
23*f*1 Inner arc surface
23*f*2 Outer arc surface
25 Extension spring
26 Sector gear
26*c* Open-lever operating piece
26*d* Closing lever operating portion
27 Motor unit
27*a* Motor (opening/closing body drive motor)
27*b* Pinion
27*c* Socket
30 Ratchet detection switch (open-state detector)
31 Open-lever detection switch (open-state detector)
32 Electronic control unit (ECU)
33 Sector gear detection switch
34 Pressing member
35 36 37 Wire harness
35*a* 36*a* 37*a* Bent portion
38 Connector
39 Wire harness
39*a* Bent portion
43 Wire harness
43*a* Connector
43*b* Bent portion
50 Battery (Power source)
60 Control unit
61 Freeze determiner
62 Freeze releaser
70 Open-operational switch
80 Temperature sensor (Temperature detector)
90 Timer
SW1 First relay switch
SW2 Second relay switch
SW3 Third relay switch

The invention claimed is:

1. An opening/closing body drive device, comprising:

an opening/closing body which opens and closes an opening;

an opening/closing-body drive motor, which drives said opening/closing body to open and close by a forward/reverse rotation of said opening/closing-body drive motor;

a battery which generates drive current for said opening/closing-body drive motor;

a supplier which supplies said drive current that is generated by said battery to said opening/closing-body drive motor;

a switching device which switches the forward/reverse rotational direction of said opening/closing-body drive motor;

a control unit which controls said supplier and said switching device based on opening/closing operational conditions of said opening/closing body; and a temperature detector which detects the temperature of said control unit, wherein at least one of said supplier and said switching device includes a relay switch, and wherein said control unit comprises:

a freeze determiner which determines that said relay switch is frozen due to a lowering surrounding temperature when said opening/closing-body drive motor does not drive a specified amount in accordance with said opening/closing operational conditions of said opening/closing body and when the temperature of said control unit that is detected by said temperature detector is lower or equal to a predetermined value; and a freeze releaser which releases a frozen state of said relay switch by intermittently supplying electric current for a predetermined number of times to said relay switch without supplying a drive current to said opening/closing-body drive motor, when said freeze determiner determines that said relay switch is frozen.

2. The opening/closing body drive device according to claim 1, wherein said supplier and said switching device comprise said relay switches, wherein said relay switches include three relay switches: a first relay switch which switches ON and OFF the supply of said drive current generated by said battery to said opening/closing-body drive motor, and second and third relay switches which change the direction of supply of said drive current generated by said battery to said opening/closing-body drive motor.

3. The opening/closing body drive device according to claim 1, further comprising a sector gear which rotates between an initial position and a position other than said initial position, in accordance with the forward/reverse rotation of said opening/closing-body drive motor, wherein said freeze determiner determines that said relay switch is frozen when said sector gear cannot return to the initial position thereof from a position other than the initial position due to said opening/closing-body drive motor not being able to be driven forwardly, after the sector gear has been moved from the initial position to a position other than the initial position so that said opening/closing body is in an opened state by reversibly driving said opening/closing-body drive motor from said fully-closed state of said opening/closing body, and when the temperature of said control unit detected by said temperature detector is less than or equal to said predetermined temperature.

* * * * *